US005473982A

United States Patent [19]

Hirata et al.

[11] Patent Number: 5,473,982

[45] Date of Patent: Dec. 12, 1995

[54] STAMP APPARATUS HAVING MEANS TO PRODUCE STENCILS

[75] Inventors: Koichi Hirata; Toshihide Fujikawa, both of Nagoya, Japan

[73] Assignee: Brother Kogyo Kabushiki Kaisha, Aichi, Japan

[21] Appl. No.: 31,817

[22] Filed: Mar. 15, 1993

[30] Foreign Application Priority Data

Mar. 18, 1992 [JP] Japan ..... 4-061979
May 27, 1992 [JP] Japan ..... 4-135165

[51] Int. Cl.[6] ..... B41L 13/00; B41C 1/00

[52] U.S. Cl. ..... 101/125.4; 101/125.21; 400/76

[58] Field of Search ..... 101/127, 127.1, 101/128, 128.1, 128.21, 128.4; 400/76

[56] References Cited

U.S. PATENT DOCUMENTS

| | | | |
|---|---|---|---|
| 3,799,053 | 3/1974 | Rabelow . | |
| 4,934,851 | 6/1990 | Sasaki | 400/63 |
| 5,184,549 | 2/1993 | Imamaki et al. | 101/128.21 |
| 5,195,832 | 3/1993 | Fujikawa et al. | 101/128.21 |
| 5,222,431 | 6/1993 | Kawahara | 101/128.21 |
| 5,253,581 | 10/1993 | Miki et al. | 101/127.1 |

FOREIGN PATENT DOCUMENTS

| | | |
|---|---|---|
| 59-40231 | 11/1984 | Japan . |
| 63-17074 | 1/1988 | Japan . |
| 227361 | 2/1990 | Japan . |

OTHER PUBLICATIONS

Patent Abstracts of Japan vol. 12, No. 302 (M-732) (3149) 17 Aug. 1988; & JP-A-63 77 742 (Seiko Epson Corp) 7 Apr. 1988.

Patent Abstracts of Japan vol. 15, No. 305 (P-1234) 5 Aug. 1991 & JP-A-31 07 998 (Brother) 8 May 1991.

European Search Report Application EP 93 30 2055 dated Jul. 14, 1993.; Communication No. 93302055.4 dated Jul. 30, 1993.

*Primary Examiner*—Edgar S. Burr
*Assistant Examiner*—John S. Hilten
*Attorney, Agent, or Firm*—Kane, Dalsimer, Sullivan, Kurucz, Levy, Eisele and Richard

[57] ABSTRACT

A stencil producing apparatus for producing a stencil having a desired stencil image is provided with a storing unit for storing a plurality of image forming elements. The stencil producing apparatus is further provided with a selecting unit for selecting one of the plurality of image forming elements which corresponds to a desired stencil image. In the stencil producing apparatus, a perforating unit selectively perforates a blank stencil paper to form a hole corresponding to the selected image forming element, to thereby produce a stencil having the desired stencil image.

21 Claims, 17 Drawing Sheets

FIG. 2a

ESTIMATE ENCLOSED

FIG. 2b

OFFICE MEMO
(Initial and date)

FIG. 2c

INVOICE ENCLOSED

FIG. 2d

THIS END UP

FIG. 2e

FOR YOUR EYES ONLY

STAMP APPARATUS HAVING MEANS TO PRODUCE STENCILS

BACKGROUND OF THE INVENTION

1. Field of the Invention

The present invention relates to a stamp apparatus for stamping a desired image onto an object and more particularly to improvements in ease at which desired images can be produced.

2. Description of the Related Art

There has been proposed one type of conventional stamp apparatus in Japanese Unexamined Utility Model Application Publication No. HEI-2-27361. FIGS. 1*a*, 1*b*, and 1*c* show a front view, side view, and top view respectively of the stamp apparatus. The stamp apparatus includes a casing 85 which forms substantially an inverted L-shape when viewed from the side as in FIG. 1*b*. A block portion 83 forms the horizontal section of the inverted L-shape and a board portion 84 forms the vertical section of the inverted L-shape, the block portion 83 being connected to the board portion 84. To the front of the block portion 83, as shown in FIG. 1*a*, is provided a display 82. As shown in FIG. 1*b*, to the rear of the block portion 83, i.e., the side of the block portion 83 opposing the display 82, is provided a window hole 81. To the front side of the board portion 84 and beneath the display 82, as shown in FIG. 1*a*, are provided keys 89 representing various characters such as alphanumeric letters and symbols.

Within the casing 85, as can be seen in FIG. 1*c*, there are mounted an endless loop belt 86 with the characters represented by the keys of the board portion 84 being formed along the length of an outer side thereof, a loop belt drive mechanism (not shown), an ink dispenser 87 for applying ink to the characters formed along the loop belt 86, and a fixed hammer 88 installed to strike the loop belt 86 from the inner side thereof toward the window hole 81.

When a key of this stamp apparatus is depressed, the loop belt drive mechanism rotates the loop belt 86 until the character formed thereon represented by the depressed key arrives at the position in front of the hammer 88 in such a manner that the character faces toward the window hole 81 and away from the hammer 88. The hammer 88 then strikes the side of the belt loop opposing the character, so that the character is stamped in ink onto an object to be stamped.

There has been a problem with the conventional stamp apparatus, however, in that regardless of how frequently a certain phrase is used, each time the phrase is required, each character in the phrase must be separately input with the keys 89 because each key 89 corresponds to only one character on the loop belt 86. For example, to stamp the phrase "ESTIMATE ENCLOSED" on an envelope as shown in FIG. 2*a*, requires pressing at least 17 keys. There has been another problem with the conventional stamp apparatus in that forming stamps which, as shown in FIG. 2*b*, have characters with a variety of sizes, especially when formed on a plurality of lines, requires increasing the length of the loop belt 86 to accommodate the extra different sized characters. The longer loop belt 86 in turn requires increasing the overall size of the stamp apparatus.

There has been proposed another type of electronic stamp apparatus in Japanese Examined Utility Model Application Publication No. SHO-59-40231. FIG. 3*b* schematically shows a base portion 93 of the stamp apparatus. The base portion 93 is formed from a first glass plate 91 and a second glass plate 92, both glass plates having a rectangular shape. The rectangular shape of the first glass plate 91 has a width equal to, but a length longer than, that of the second glass plate 92. A broad surface of the second glass plate 92 is attached to the first glass plate 91 at a broad surface thereof, the first glass plate 91being aligned with the second glass plate 92 entirely along one widthwise edge thereof, and partially along two lengthwise edges thereof. The area sandwiched between the two glass plates is filled with liquid crystal so as to form a time display portion 94 on the first glass plate 91. A thermal head 96 is provided to the first glass plate 91 at a widthwise edge 95 opposing the widthwise edge at which the first glass plate is aligned with the second glass plate 92. As shown in FIG. 3*a*, the base portion 93 is mounted in a stamp frame 97. On the first glass plate 91, there are mounted an electric circuit 98 which includes a time circuit, a display drive circuit, and a stamp drive circuit. The date or time is stamped out on an object formed of thermosensitive paper, according to output from the time circuit.

There has been a problem with the above-described conventional stamp apparatus, however, in that only the date or time can be stamped. There has been another problem with the stamp apparatus in that only thermosensitive paper can be used as the object to be stamped. Also, maintaining the thermal head 96 parallel to the thermosensitive paper requires a great deal of care.

SUMMARY OF THE INVENTION

It is therefore, an object of the present invention to overcome the above-described drawbacks, and to provide a small-sized stamp apparatus which is capable of stamping various types of stamp images onto any desired kind of object through an operator's simple operation.

These and other objects of the present invention will be attained by providing a stencil producing apparatus for producing a stencil having a desired stencil image, comprising: storing means for storing a plurality of image forming elements; selecting means for selecting one of the plurality of image forming elements which corresponds to a desired stencil image; and perforating means for selectively perforating a blank stencil paper to form a hole corresponding to the selected image forming element, to thereby produce a stencil having the desired stencil image.

The storing means may include character set storing means for storing a plurality of sets of character images, each set of character images having a plurality of character images. In such a case, the selecting means includes character set selecting means for selecting one of the plurality of sets of character images which corresponds to the desired stencil image.

The storing means may include a frame storing means for storing a plurality of frame images, and the selecting means includes frame selecting means for selecting at least one of the plurality of frame images which corresponds to a part of the desired stencil image. The storing means may further include character storing means for storing a plurality character images. In such a case, the selecting means further includes character selecting means for selecting at least one of the plurality of character images which corresponds to another part of the desired stencil image. In such a case, the stencil producing apparatus is further provided with synthesizing means for synthesizing the at least one frame image selected by the frame selecting means and the at least one character images selected by the character selecting means to generate an image corresponding to the desired stencil image. The perforating means selectively perforates the blank stencil paper to form a hole corresponding to the synthesized image, to thereby produce a stencil having the desired stencil image.

The stencil producing apparatus may be further provided with shape-changing means for changing a shape of the at least one frame image selected by the frame selecting means into such a shape as suits the at least one character images selected by the character selecting means. In such a case, the synthesizing means synthesizes the shape-changed at least one frame image and the selected at least one character images to generate the image corresponding to the desired stencil image.

According to another aspect of the present invention, a stamp apparatus for stamping a desired stamp image onto a desired any kind of object, comprises: storing means for storing data of a plurality of stamp images and a plurality of codes representative of the plurality of stamp images; input means for inputting a code representative of a stamp image desired to be stamped onto a desired object; selecting means for selecting one of the plurality of stamp images stored in the storing means in accordance with the code inputted in the input means; supporting means for supporting a blank stencil medium; perforating means for selectively forming a hole on the blank stencil medium supported by the supporting means, in accordance with data of the selected stamp image to thereby produce a stencil formed with a stencil image corresponding to the desired stamp image; and ink supply means for supplying ink onto the produced stencil, to thereby form the desired ink stamp image on the desired any kind of object.

The ink supply means may include: an ink pad permeated with ink; placing means for placing the stencil on the object; and pressing means for pressing the ink pad against the object through the stencil.

According to further aspect, the present invention provides a stamp producing apparatus for producing a stamp member capable of stamping a desired stamp image onto a desired any kind of object. The stamp producing apparatus comprises: character storing means for storing data of a plurality of character images and a plurality of character codes representative of the plurality of character images; frame storing means for storing data of a plurality of frame images and a plurality of frame codes representative of the plurality of frame images; input means for inputting at least one character code representative of at least one character image desired to be contained in a stamp image desired to be stamped on a desired any kind of object and at least one frame code representative of at least one frame image desired to be combined with the at least one character image into the desired stamp image; selecting means for selecting at least one of the plurality of character images stored in the character storing means in accordance with the character code inputted in the input means and for selecting at least one of the plurality of frame images stored in the frame storing means in accordance with the frame code inputted in the input means; combining means for combining data of the selected at least one character images and data of the selected at least one frame images into data of the desired stamp image; supporting means for supporting a blank stencil medium; perforating means for selectively forming a hole on the blank stencil medium supported by the supporting means, in accordance with the data of the desired stamp image produced by the combining means, to thereby produce a stencil formed with a stencil image corresponding to the desired stamp image; and attaching means for attaching the thus produced stencil onto a stencil holding member to thereby produce a stamp member capable of stamping the desired stamp image onto a desired any kind of object.

The frame storing means may store therein data of a plurality of basic frame images and a plurality of basic frame codes representative of the plurality of basic frame images. In such a case, the input means receives a plurality of basic frame codes representative of a plurality of basic frame images which are desired to be respectively contained in a plurality of image sections of the desired stamp image and receives at least one character code representative of at least one character image desired to be contained in each of the plurality of image sections of the desired stamp image. The selecting means selects at least one character image out of the character storing means in accordance with the character code inputted in the input means and selects the plurality of basic frame images out of the frame storing means in accordance with the plurality of basic frame codes inputted in the input means. The combining means includes: image section data producing means for combining data of each of the selected plural basic frame images and data of the selected at least one character images desired to be contained in the corresponding one of the plurality of basic frame image into data for each of the plurality of image sections of the desired stamp image; and image data producing means for combining data for all of the plurality of image sections of the desired stamp image into data of the desired stamp image.

The frame storing means may store therein data of a plurality of composite frame images and a plurality of composite frame codes representative of the plurality of basic frame images, each of the plurality of composite frame images including a plurality of basic frame images. In such a case, the input means receives one composite frame code representative of one composite frame image which is desired to be contained in the desired stamp image and which has a plurality of basic frame images defining a plurality of image sections of the desired stamp image and receives at least one character code representative of at least one character image desired to be contained in each of the plurality of image sections of the desired stamp image. The selecting means selects at least one character image out of the character storing means in accordance with the character code inputted in the input means and selects one composite frame image out of the frame storing means in accordance with the one composite frame code inputted in the input means. The combining means includes: image section data producing means for combining data for each of the plural basic frame images of the selected one composite frame image and data of the selected at least one character images desired to be contained in the corresponding basic frame image into data for each of the plurality of image sections of the desired stamp image; and image data producing means for combining data for all of the plurality of image sections of the desired stamp image into data of the desired stamp image.

The blank stencil medium may include an ink pad layer permeated with ink and a stencil image receiving layer formed of material capable of being perforated by the perforating means.

In the present description, characters such as alphanumeric characters, e.g., Japanese, English or other alphabets, letters, symbols such as a circle, rectangle, etc., and other symbols will be all referred to as "characters."

BRIEF DESCRIPTION OF THE DRAWINGS

The above and other objects, features and advantages of the invention will become more apparent from reading the following description of the preferred embodiment taken in connection with the accompanying drawings in which:

FIGS. 2*a*, 2*b*, 2*c*, 2*d* and 2*e* show examples of stamp images to be stamped on an object:

DETAILED DESCRIPTION OF THE PREFERRED EMBODIMENTS

Figure 1A:
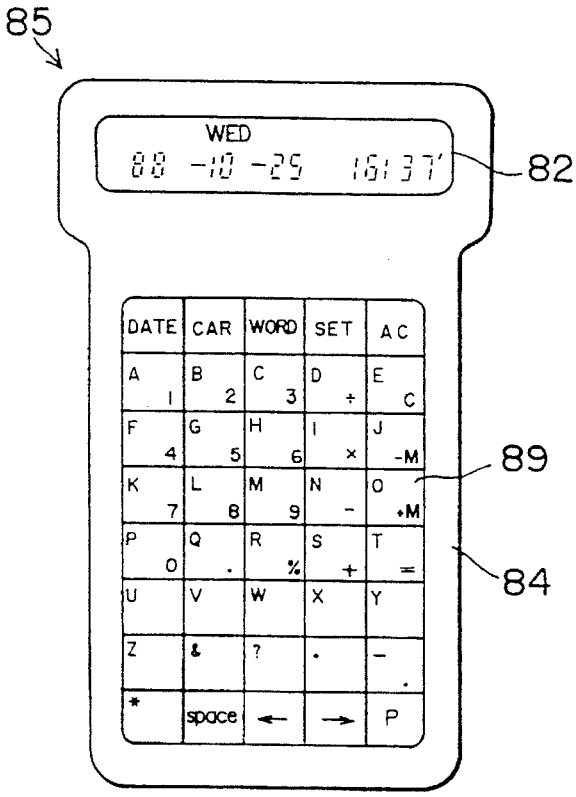
FIG. 1*a* is a front view of one type of conventional stamp apparatus.
Figure 1B:
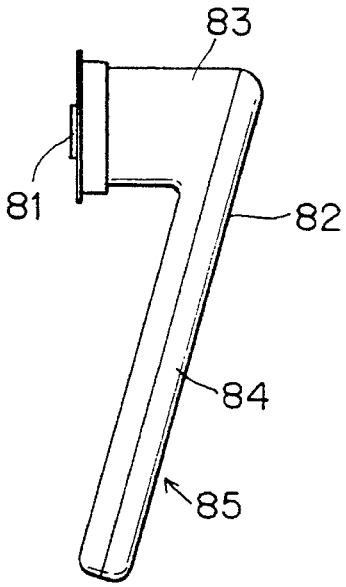
FIG. 1*b* is a side view of the conventional stamp apparatus.
Figure 1C:
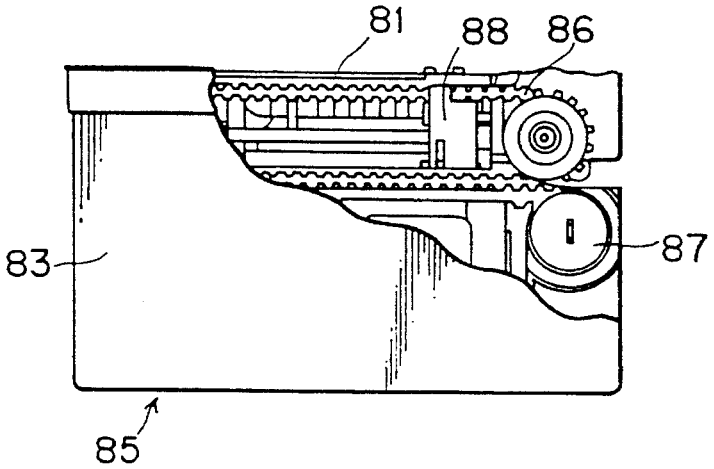
FIG. 1*c* is a top view of the conventional stamp apparatus which partly shows an inside thereof.
Figure 3A:
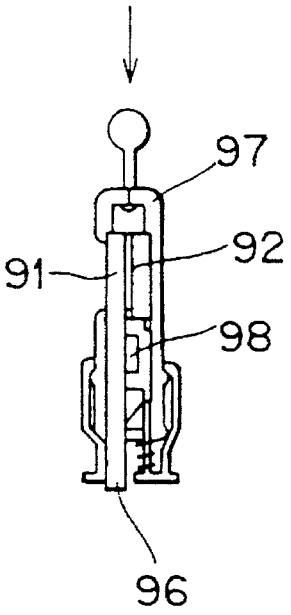
FIGS. 3*a* and 3*b* are a cross-sectional view and a perspective view of another type of conventional stamp apparatus.
Figure 3B:
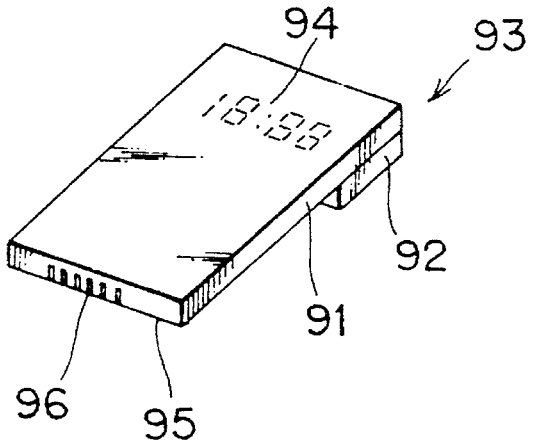

Referring to the accompanying drawings, preferred embodiments of the present invention will be described wherein the same or like parts and components are designated by the same reference numerals or characters to avoid duplicating description.

A first preferred embodiment will be described hereinafter with reference to FIGS. 2 and 4 through 6.

Figure 4:
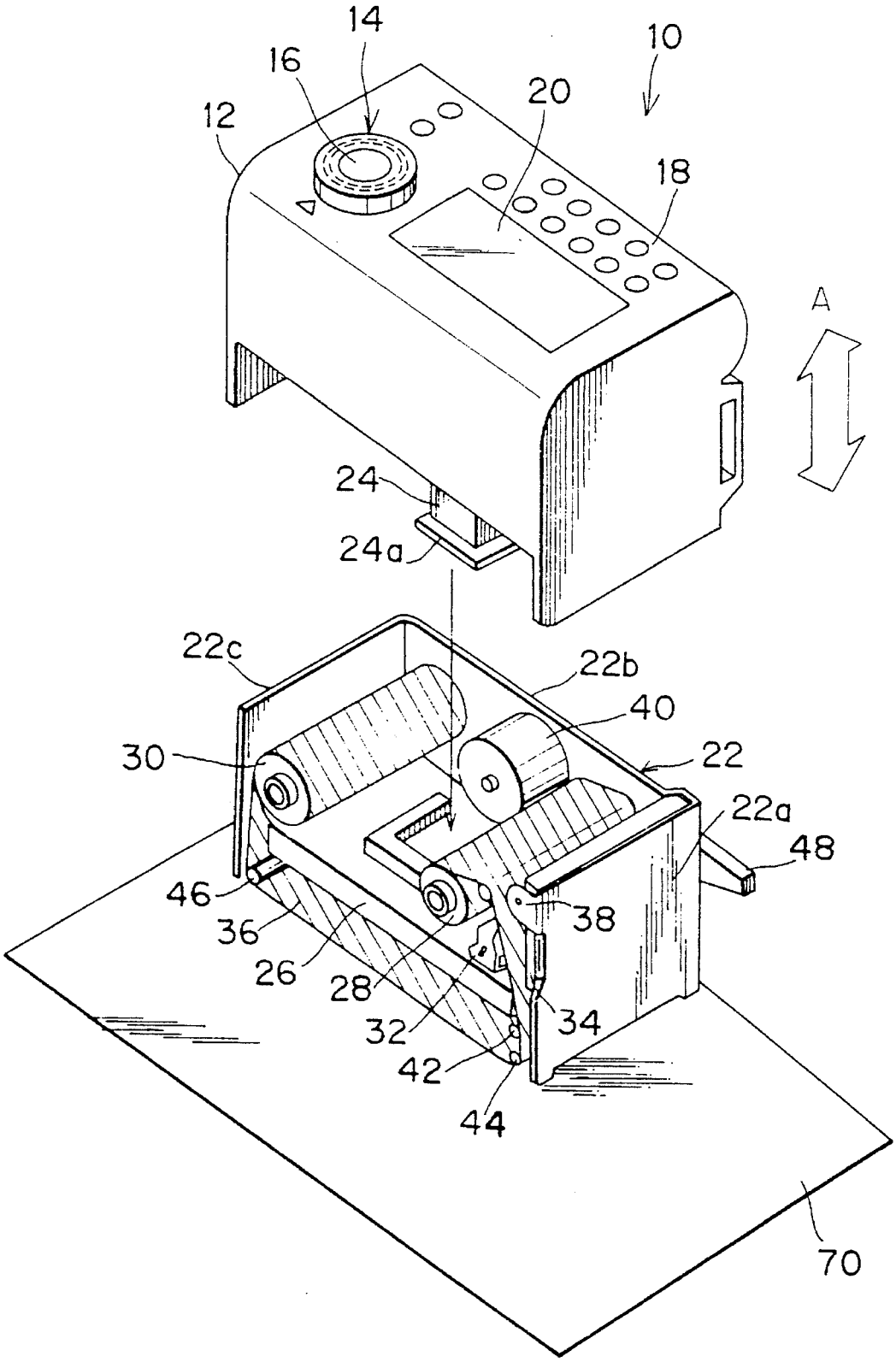
FIG. 4 is a partially exploded perspective view of a stamp apparatus according to a first preferred embodiment of the present invention.

FIG. 4 is a partially exploded perspective view showing a stamp apparatus 10 according to the first preferred embodiment of the present invention. The stamp apparatus 10 generally has a housing 12 and a chassis 22. The housing 12 is formed of, for example, a resin material, and is in a six-sided box shape with one side open, the chassis 22 being insertable therein. Accordingly, the stamp apparatus 10 is constructed by inserting the chassis 22 into the housing 12. The housing 12 can be vertically moved relative to the chassis 22 as marked by the arrow labeled A in FIG. 4.

To the top of the housing 12 is provided a circular rotatable dial 14 following the perimeter of which are provided such characters as alphanumeric characters (e.g. Japanese or English alphabet) and other symbols. In the center of the dial 14 is provided a button 16 for selecting the characters at the perimeter of the dial 14 that are desired to be stamped.

Also to the top of the housing 12 is provided a keyboard 18 which includes a ten key, a produce-stencil key, a clear key, a power switch, and the like. At one side of the keyboard 18 is provided a display 20 (e.g., a liquid crystal display or a plasma display) which shows the characters or phrases selected through operation of the dial 14 or the keyboard 18, format at which the selected characters or phrases are to be arranged into an image, command messages and the like.

Integratedly attached to an inner surface of an upper wall of the housing 12 is a downwardly extending ink pad holder 24 with an attach member 24*a* being formed at the lower end thereof. An ink pad 26 is detachably mounted on the attach member 24*a* of the ink pad holder 24. Accordingly, when the housing 12 thus attached with the ink pad 26 is depressed, the housing 12 is moved downwardly relative to the chassis 22 so that the ink pad 26 is moved downwardly together with the housing 12 until the ink pad 26 presses through a stencil paper 36 against an object 70 to be stamped.

The chassis 22 is generally in a U-shape formed from three walls, that is, a right side wall 22*a*, a center wall 22*b*, and a left side wall 22*c*, sequentially attached at right angles in FIG. 4. In order to replace an old ink pad 26 with a new one, the old ink pad 26 is first detached from the attach member 24*a* and removed from the stamp apparatus 10 through the open side of the U-shaped chassis 22.

Inside the chassis 22, a blank stencil paper supply spool 28, a platen 32, stencil guide rollers 42, 44 and 46, and a stencil paper take-up spool 30 are rotatably attached to the center wall 22*b*. A thermal head 34 is swingably attached to the right side wall 22*a* around an axis 38. The thermal head 34 is operated to selectively melt the blank stencil paper 36 supplied from the supply spool 28, to thereby form holes therein which define a stencil image. It is noted that a blank stencil paper 36 from the supply spool 28 is ordinarily sandwiched between the platen 32 and the thermal head 34 to be pressed therebetween.

A drive motor 40 and a drive mechanism (not shown) are also provided inside of the chassis 22 for rotating the take-up spool 30 so that the take-up spool 30 may take up the stencil paper 36 from the supply spool 28. More specifically, the take-up spool 30 is driven by the motor 40 to rotate to wind up a set length of the stencil paper 36 so that an area of the stencil paper 36 which has passed between the thermal head 34 and the platen 32 and which has been formed with the stencil image is guided by the guide rollers 42, 44, and 46 to reach a position directly below the ink pad 26.

A release bar 48 is swingably attached to the chassis 22. By operating the release bar 48, the stencil paper 36 which is, as mentioned previously, normally intimately sandwiched between the thermal head 34 and the platen 32, is released by well-known means not shown in the figure, for easy replacement of the blank stencil paper 36.

Figure 5:
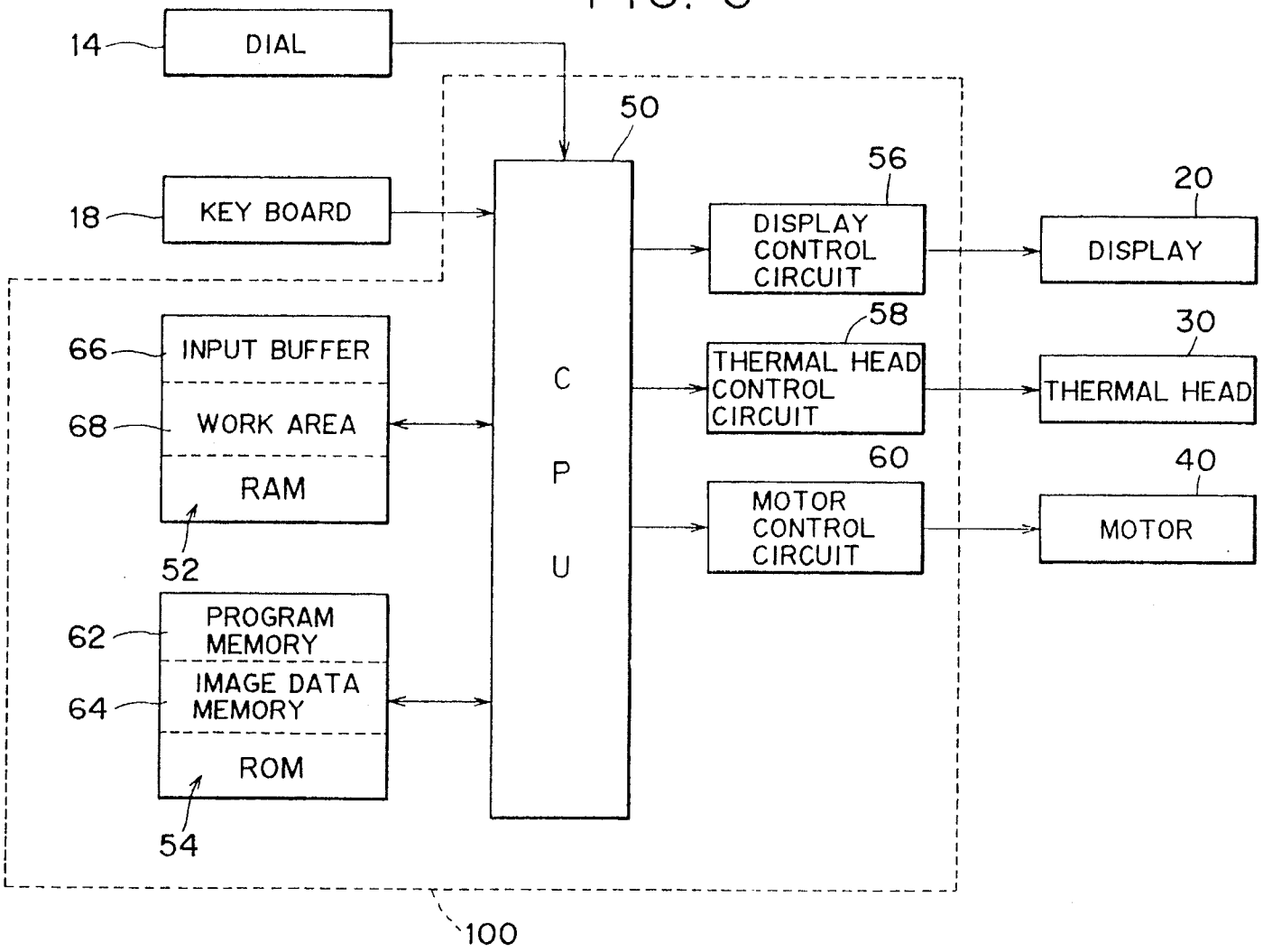
FIG. 5 is a block diagram of an operation control unit provided in the stamp apparatus of FIG. 4.

An operation control unit 100 is equipped in the stamp device 10 (not shown in FIG. 4). A block diagram of the operation control unit 100 is shown in FIG. 5. The operation control unit 100 includes a central processing unit (CPU 50), and a RAM 52, a ROM 54, a display control circuit 56, a thermal head control circuit 58, and a motor control circuit 60 which are all connected to the CPU 50. The CPU 50 is also connected to the dial 14 from which data representative of characters to be stamped on the object 70 can be inputted to the CPU 50. The CPU 50 is further connected to the keyboard 18 from which data representative of phrases to be stamped can be inputted to the CPU 50. The display control circuit 56 is connected to the display 20, the thermal head control circuit 58 is connected to the thermal head 34, and the motor control circuit 60 is connected to the motor 40.

The ROM 54 has a program memory 62 and an image data memory 64. The program memory 62 stores therein an operating program for controlling an operation of the entire apparatus 10 which will be described later. The image data memory 64 stores therein a plurality of sets of phrase image data for phrase images such as those shown in FIGS. 2*a* through 2*e* which are frequently stamped on objects and a plurality of codes representative of the plurality of phrase image data (which will be referred to as "phrase codes", hereinafter.) In this description, the word "phrase" is intended to mean one or more strings of characters such as alphanumeric characters, letters, and other various types of symbols, e.g., rectangles, circles, etc. In other words, the "phrase" refers to a plurality of characters arranged or distributed to form a stamp image.

Each set of phrase image data contains information required to control the thermal head 34 to selectively melt the stencil paper 36 for producing holes defining a stencil image of the corresponding phrase. Each set of phrase image data is represented by a corresponding phrase code which has, for example, a two-digit number. The phrase code is inputted through the operation of the ten key on the keyboard 18. For the following description, now assume that phrase codes of two-digit numbers "11" and "12" represent the phrase images as shown in FIGS. 2*a* and 2*b*, respectively.

The image data memory 64 further stores therein a plurality of sets of character image data and a plurality of codes representative of the plurality of character image data (which will be referred to as "character codes", hereinafter.) Each set of character image data represents one of the characters inputtable through the operation of the dial 14, and contains information required to control the thermal head 34 to selectively melt the stencil paper 36 for producing holes defining a stencil image of the corresponding character. Each set of character image data is represented by a corresponding character code. The character code is inputted through the operation of the dial 14. It is noted that each of the plural character codes for the plural sets of character image data is different from the plural phrase codes for the plural sets of phrase image data. In this illustration, since each phrase code has a two-digit number, each character code has data other than a two-digit number.

The RAM 52 preserves therein an input buffer 66, a work area 68, several registers and other buffers. The input buffer 66 serves to temporarily store therein a phrase code for a desired phrase image which has been inputted through the operation of the ten key on the keyboard 18 or at least one character code for desired at least one character image which has been inputted through the operation of the dial 14. The phrase code thus stored in the input buffer 66 serves as a command for instructing the CPU 50 to retrieve from the image data memory 64 the phrase image data represented by the phrase code. The character code stored in the input buffer 66 serves as a command for instructing the CPU 50 to retrieve from the image data memory 64 the character image data represented by the character code. The work area 68 in the RAM 52 temporarily stores therein the phrase image data or the character image data retrieved from the image memory 64. The phrase image data or the character image data thus stored in the work area 68 will be transmitted to the thermal head controlling circuit 58.

In order to stamp a desired stamp image on the object 70, an operator operates the stamp apparatus 10, in the following manner.

The operator first places the apparatus 10 on a desired object 70. The operator turns ON the power switch on the keyboard 18 on the apparatus 10. Then, if the operator desires to obtain a stamp image having a frequently used phrase, the operator depresses the ten keys on the keyboard 18 to thereby input a phrase code representative of the desired phrase. For example, when the operator desires to stamp a stamp image shown in FIG. 2*a*, the operator depresses the ten keys to input the phrase code data of "11". On the other hand, if the operator desires to obtain a stamp image other than the frequently used phrase, the operator rotates the dial 14 to select the desired characters and depresses the button 16 to thereby input character codes representative of the selected desired characters. After when the operator thus selects the desired phrase or characters, the operator depresses the produce-stencil key on the keyboard 18, so as to allow the apparatus 10 to start producing a stencil image corresponding to the desired phrase or characters on the blank stencil paper 36. When the stencil image is produced on the stencil paper 36 and is positioned below the ink pad 26, the operator depresses downwardly the housing 12 relative to the chassis 22. As a result, the ink pad 26 is pressed against the object 70 through the stencil paper 36, and the desired ink image is formed on the object 70.

Figure 6:
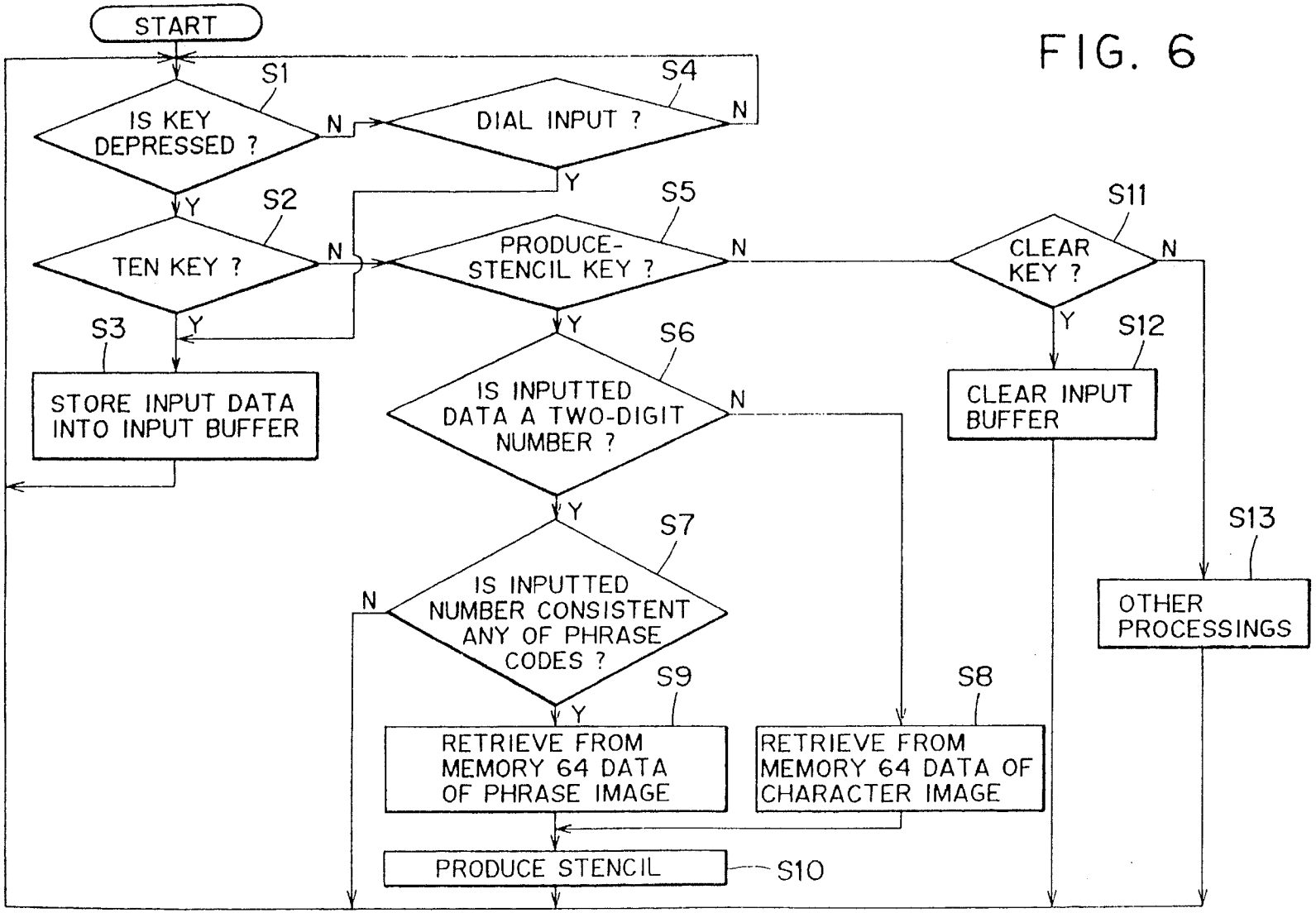
FIG. 6 is a flow chart showing operation of the stamp apparatus of FIG. 4.

The operation of the stamp device 10 will be described below, in detail with reference to a flow chart shown in FIG. 6. As shown in the flowchart of FIG. 6, when the operator turns the power switch ON, initial settings such as clearing, for example, contents of the input buffer 66 are executed. Then, the program enters a stand-by mode in step S1 where the CPU 50 judges whether or not any key on the keyboard 18 is depressed. When the operator desires to obtain a frequently used phrase image, the operator depresses a ten key on the keyboard 18, and therefore, the step S1 judges that a key on the keyboard 18 is depressed. Then, the program proceeds to step S2 which judges whether or not the depressed key is a ten key. Since the ten key is now depressed, program proceeds to step S3 where data inputted through the operation of the ten key is stored in the input buffer 66. The program then returns to step S1 and judges whether or not a key at the keyboard 18 is further depressed.

Afterwardly, when the operator operates the ten key to completely input a phrase code representative of the desired phrase image, the operator depresses the produce-stencil key. Since the produce-stencil key is a key on the keyboard 18, the program proceeds from step S1 to step S2. Since the depressed key is not a ten key in this case, the program proceeds to step S5 where it is judged whether or not the depressed key is the produce-stencil key. Since the produce-stencil key is now depressed, the program proceeds to step S6 where it is judged whether or not the data which has been inputted in the input buffer 66 is a two-digit number. In this case, since the operator has operated the ten key on the keyboard 18 to input the two-digit number "11" into the input buffer 66, program proceeds to step S7. Step S7 then judges whether or not the two-digit number thus inputted in the input buffer 66 is consistent with any one of the plurality of two-digit numbers (the phrase codes) stored in the image data memory 64. If the inputted two-digit number is consistent with one of the plurality of phrase codes stored in the image data memory 64, program proceeds to step S9 where the CPU 50 retrieves, from the image memory 64, the phrase image data represented by a phrase code consistent with the inputted number and inputs it to the work area 68 in the RAM 52. Then, program proceeds to step S10 to perform a stencil producing operation.

If the operator desires to obtain a stamp image having characters different from the frequently used phrases, on the other hand, the operator does not operate the ten key on the keyboard. Accordingly, program proceeds from step S1 to step S4 where it is judged whether or not the dial 14 is operated. When the operator operates the dial 14, the program proceeds to step S3 where the data (character code) inputted through the operation of the dial 14 is inputted into the input buffer 66. When the operator depresses the produce-stencil key, the program proceeds from step S1 through steps S2 and S5 to step S6 where it is determined that the data which has been inputted into the input buffer 66 is a two-digit number. Since the data (character code) inputted through the operation of the dial 14 is different from a two-digit number, program proceeds to step S8 where the character image data represented by the inputted data, i.e., the inputted character code is retrieved from the image memory 64 to be inputted into the work area 68 in the RAM 54. Then, program proceeds to step S10.

In step S10, the CPU 50 controls the display control circuit 56 to allow the display 20 to display an image represented by the phrase or character image data now stored in the work area 68. The CPU then transmits the phrase or character image data from the work area 68 to the thermal head control circuit 58. The thermal head control circuit 58 controls the thermal head 34 in response to the phrase or character image data to selectively melt the blank stencil paper 36, while the CPU 50 controls the motor 40 via the motor control circuit 60 to feed the stencil paper 36. As a result, perforations corresponding to the desired phrase or characters are formed on the blank stencil paper 36.

For example, when the operator desires to stamp the phrase image shown in FIG. 2*a* onto the object 70, since the phrase image is represented by the phrase code "11" as described above, the operator operates the keyboard 18 to depress the ten key to input the number "11". Since the inputted number "11" is a two-digit number and is consistent with one of the plural phrase codes stored in the image data memory 64, steps S7 and S9 are executed in which a set of phrase image data corresponding to the phrase code of "11" is retrieved from the image data memory 64 and perforations corresponding to the phrase image of FIG. 2*a* are formed on the stencil paper 36.

On the other hand, when the operator desires to stamp an image having at least one character image other than the frequently used phrases, the operator operates the dial 14 to input at least one character code. Since the character code is not a two-digit number, step S8 is executed in which a set of character image data corresponding to the inputted character code is retrieved from the image data memory 64, and perforations corresponding to the character image are formed on the stencil paper 36.

When the operator desires to further stamp another stamp image on the object 70, the operator depresses the clear key. Accordingly, when it is judged that the clear key is depressed in step S11, the input buffer 66 is cleared in step S12. The program then returns to the stand-by mode in the step S1 judging whether or not any key is depressed. For example, if the operator desires to further stamp the phrase image shown in FIG. 2*b* onto the object 70 after stamping the phrase of FIG. 2*a*, the operator depresses the clear key before depressing the ten key to input the number "12" consistent with the character code data representative of the phrase image of FIG. 2*b*. In the similar manner, it is possible to select other various phrases such as shown in FIGS. 2*c* through 2*e*.

When the operator desires to amend the data already inputted into the input buffer 66, the operator does not depress either the produce-stencil key or the clear key. Accordingly, program proceeds to step S13 where the already inputted data is canceled.

The stencil production operation executed in step S10 according to the stamp device 10 will be explained below with referring to FIG. 4. In step S10, the take-up spool 30 is driven by the motor 40 to be rotated to wind up the blank stencil paper 36 at a fixed speed thereby transporting the blank stencil paper 30 from the supply spool 30 into between the thermal head 34 and the platen 32. The thermal head 34 is selectively heated according to the phrase or character image data supplied from the work area 68 of the RAM 52, thereby melting holes in the blank stencil paper 36 to produce a stencil for stamping the desired phrase or character image. The take-up motor 40 continues to rotate the take-up spool 30 until the stenciled area on the stencil paper 36 is positioned directly beneath the ink pad 26, and then the take-up motor 40 stops.

When the operator depresses downwardly the housing 12 toward the chassis 22, as described above, the ink pad 26 downwardly moves integratedly with the housing 12 and presses through the stencil paper 36 against the object 70. The ink contained in the ink pad 26 passes through the holes on the stencil 36 which form the desired phrase or character image and saturate corresponding points on the object 70. The saturated areas form an ink image generally corresponding to the phrase or character image.

As described above, according to the stamp apparatus of the present invention, since a stencil formed with a stencil image corresponding to the desired stamp image is produced, it is possible to stamp the desired stamp image onto any desired kind of object.

In addition, it is possible to produce a stencil for a frequently required stamp image through merely inputting a simple code therefor and pressing the produce-stencil key. Therefore, even a stencil for a relatively complicated stamp image such as a phrase or sentence can be produced without complicated key operations or without increasing the size of the stamp apparatus.

Furthermore, the stamp apparatus according to the present invention occupies considerably less space and costs less money than the comparable number of rubber stamps. Also stencils for desired stamps can be immediately produced, thus eliminating the need to order stamps and wait for delivery thereof.

In the embodiment described herein, one phrase code represents one entire phrase image. However, stamps can be divided into sub-stamps and each sub-stamps provided with a separate code. The sub-stamps can be combined to form a variety of stamp images. For example, the stamp shown in FIG. 2*a*, "ESTIMATE ENCLOSED," can be divided into two sub-stamps, "ESTIMATE" and "ENCLOSED," and each sub-stamp provided with a separate code, for example, "15" and "16" respectively. A third sub-stamp, "INVOICE," with the code "17," could be combined with the sub-stamp "ENCLOSED" by inputting the codes "17" and "16" to produce a new stamp image, "INVOICE ENCLOSED," as shown in FIG. 2*c*. Sub-stamps are not limited to words, but can also be frequently used phrases, single calligraphic characters, and the like.

A second preferred embodiment of the present invention will be described hereinafter with reference to FIGS. 7*a* through 18*b*.

Figure 7A:
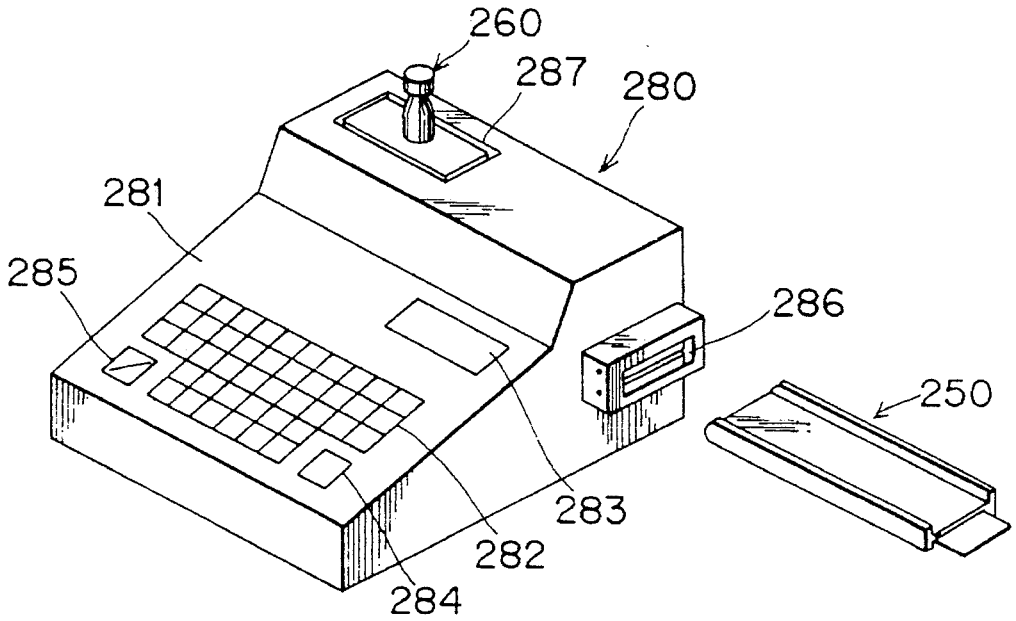
FIG. 7*a* is a perspective view of a stamp producing apparatus according to a second preferred embodiment of the present invention.
Figure 7B:
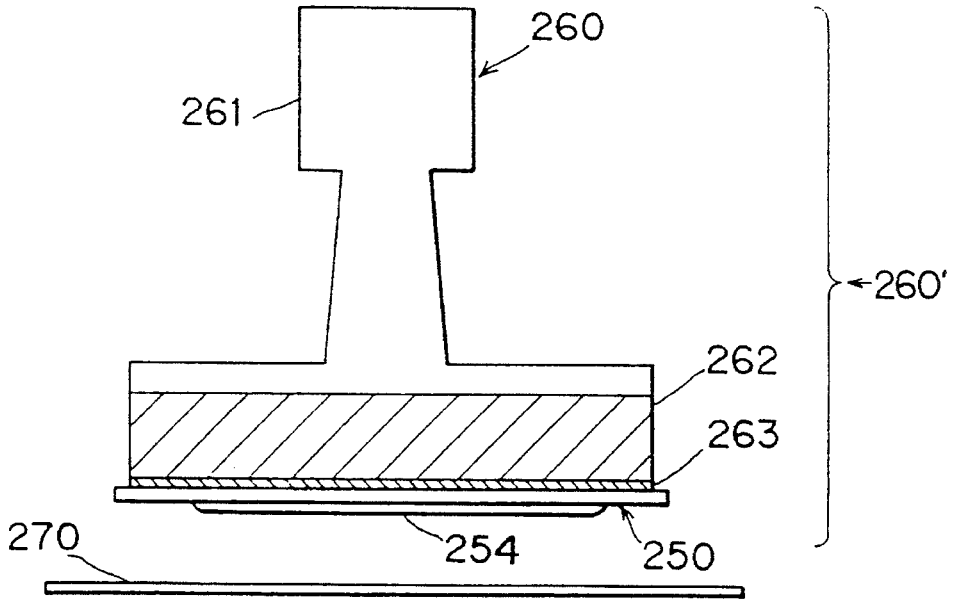
FIG. 7*b* is a cross-sectional view of a stamping member obtained by the stamp producing apparatus of FIG. 7*a;*
Figure 8A:
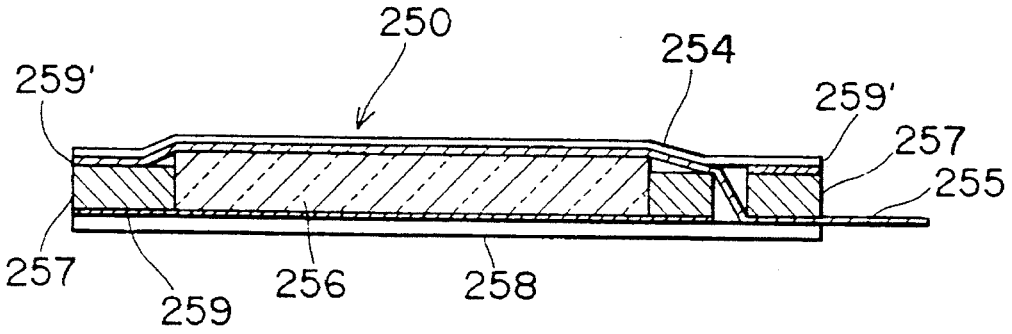
FIG. 8*a* is a cross-sectional view of a blank stencil plate used in the stamp producing apparatus of FIG. 7*a;*
Figure 8B:
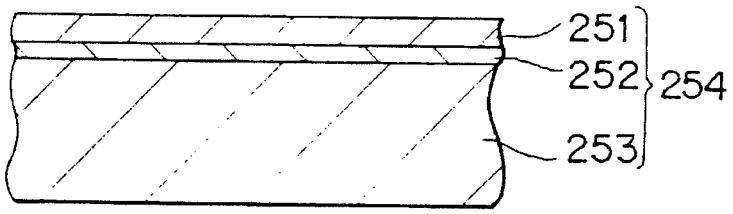
FIG. 8*b* is an enlarged view of a part of the blank stencil plate of FIG. 8*b;*

As shown in FIG. 7*a*, a stamp producing apparatus 280 of the present embodiment is adapted for selectively forming perforations on a blank stencil-plate 250 shown in FIGS. 8*a* and 8*b*, to produce a stencil having a desired stencil image thereon, and for attaching the thus obtained stencil to a stencil holder 260 shown in FIG. 7*b* to obtain a stamping member 260' which is capable of stamping a desired stamp image corresponding to the stencil image onto any desired object 270.

The stencil-plate 250 used for the stamp producing apparatus 280 of the present embodiment will now be described with reference to FIG. 8*a*. As shown in the figure, the stencil-plate 250 includes a film 258 formed of material impermeable to ink, a first adhesive agent layer 259 provided over the film 258, a layer of non-woven fabric 256 provided over the first adhesive agent layer 259, the non-woven fabric 256 having pores permeated with ink, a frame 257 provided to surround the non-woven fabric 256 at the perimeter thereof, a second adhesive agent layer 259' provided over the frame 257, a separator sheet 255 provided over the layer of nonwoven fabric 256, and a thermally sensitive blank stencil paper 254 provided over the separator sheet 255. As shown in FIG. 8*b*, the blank stencil paper 254 is formed from three layers, that is, a thermoplastic film 251, an adhesive agent layer 252, and a porous support layer 253.

Details of the structure of the stencil-plate 250 is described in co-pending U.S. application Ser. No. 07/994,315 by Teruo Imamaki, et al., entitled HEAT SENSITIVE STENCIL, filed on Dec. 21, 1992 based on Japanese Utility Model Applications Nos. 4-6505 and 4-1455, now U.S. Pat. No. 5,285,725, a disclosure of which is hereby incorporated by reference.

The stamp producing apparatus 280 of the present embodiment will be described below with reference to FIG. 7*a*.

The stamp producing apparatus 280 has a control panel 281 at the top-front portion thereof. On the control panel 281 is provided a keyboard 282 with keys for inputting characters and frame pattern codes representative of frame patterns for which images are desired to be produced, a liquid crystal display (LCD) 283 for displaying the inputted characters and frame patterns, a stencil-produce switch 284 for instructing start of production of the stencil, and a power switch 285.

As shown in FIG. 7*a*, the stencil producing apparatus 280 is provided with an insertion port 286 for receiving the blank stencil-plate 250 in the right-hand side thereof and a stencil-holder slot 287 for holding therein a stencil-holder 260 at the top-left-hand side thereof. In the stencil producing apparatus 280 is mounted a thermal head 217 (not shown), a stencil-plate feed motor 219 (not shown) and a stencil-plate feed mechanism (not shown) driven by the stencil-plate feed motor 219. The thermal head 217 is provided to selectively melt the thermoplastic film 251 at the surface of the blank stencil plate 250 to form perforations therein which define a stencil image. Hereinafter, the operation of forming a stencil image in the blank stencil plate 250 will be referred to as stencil production. The stencil-plate feed mechanism is provided to transport the stencil-plate 250, after being inserted into the apparatus 280 through the insertion port 286, toward a position confronting the thermal head 217. The stencil-plate feed mechanism further transports the stencil-plate 250 in confrontation with the thermal head 217 while the thermal head 217 selectively melts the thermoplastic film 251 of the stencil-plate 250, and forms the desired stencil image thereon. The stencil-plate feed mechanism further transports the resultant stencil-plate 250 into the stencil-holder slot 287 below the stencil-holder 260 placed therein.

As shown in FIG. 7*b*, the stencil-holder 260 includes a grip 261, a cushion layer 262, and an adhesive agent layer 263. The stencil-plate 250 is attached to the cushion layer 262 via the adhesive agent layer 263. After removing the separator 255 from the stencil-plate 250, as shown in FIG. 7*b*, a stamping member 260' can be obtained. Depressing the stamping member 260' against a desired object 270 creates a desired ink image (stamp image) thereon.

Figure 9:
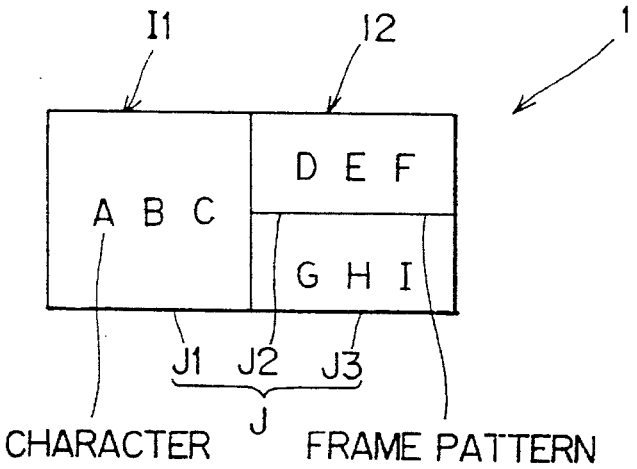
FIG. 9 schematically shows an example of an image to be obtained by the stamp producing apparatus of FIG. 7*a;*

FIG. 9 shows an example of a stamp image I to be obtained by the stamp producing apparatus 280. The stamp image I is divided into three partitioned areas: a first area I1, a second area I2 and a third area I3. The first area I1 includes a first basic frame pattern J1 in which the three alphabetic letters "A", "B" and "C" are contained. The second area I2 includes a second basic frame pattern J2 in which the three alphabetic letters "D", "E" and "F" are contained. The third area I3 includes a third basic frame pattern J3 in which the three alphabetic letters "G", "H" and "I" are contained. A combination pattern of the three basic frame patterns J1, J2 and J3 will be referred to as a "composite frame pattern J", hereinafter. It is noted that the present invention is not limited to producing stamp images containing alphabetic characters, but can also be applied for producing stamp images containing numbers, symbols such as triangles and circles, Japanese letters such as "kanji", "hiragana", and "katakana", and other various symbols.

The stamp producing apparatus 280 of the present invention is further provided with an operation control unit 200 (not shown in FIG. 7*a*). With the operation control unit 200, according to the present invention, it is possible to produce any desired stamp image through a relatively simple operation by the operator.

The principle of the operation control unit 200 will be first described below.

Figure 10:
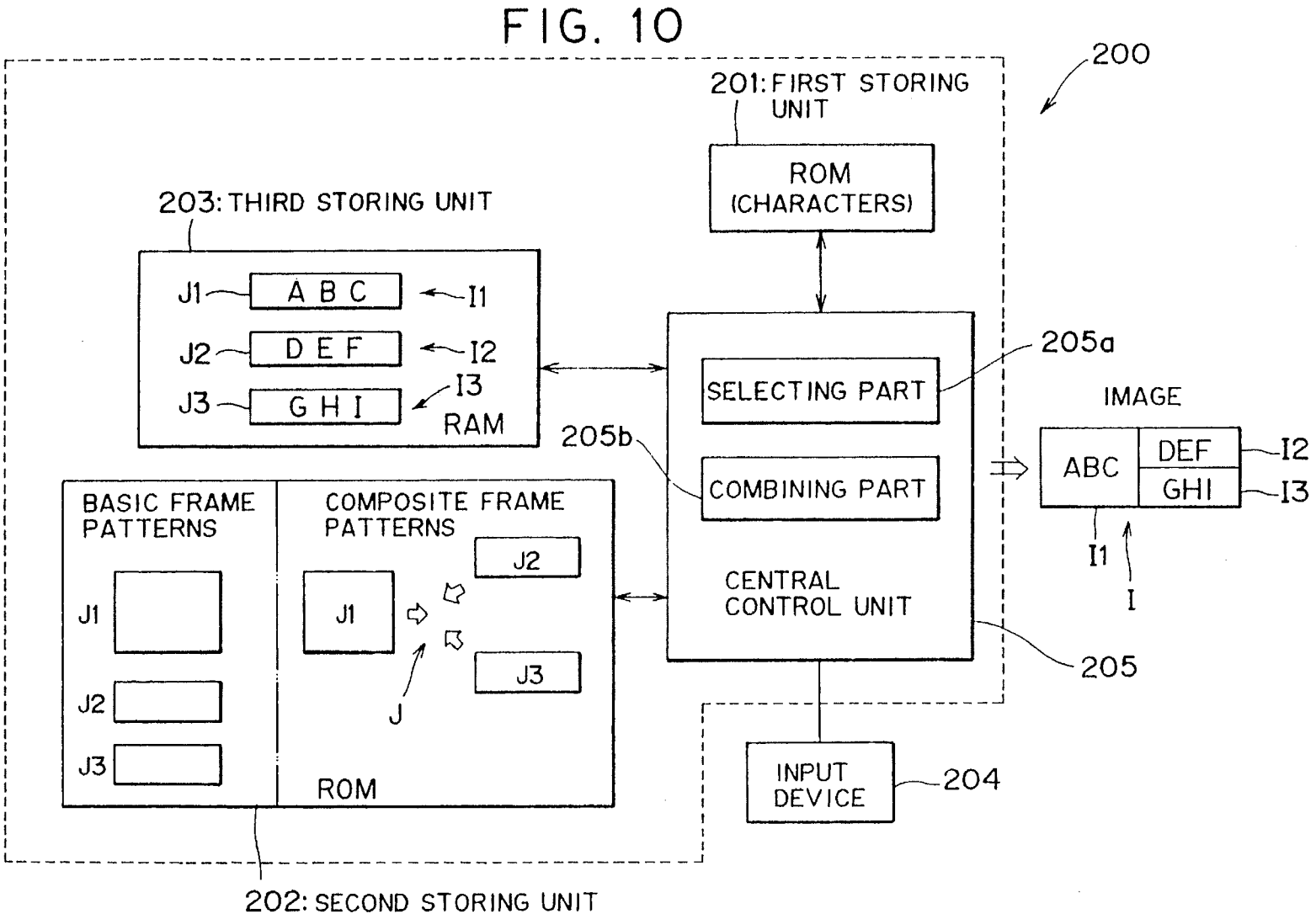
FIG. 10 is a block diagram showing a principle of an operation control unit provided in the stamp apparatus of FIG. 7*a;*

As shown in a block diagram of FIG. 10, the operation control unit 200 includes a central control unit 205 and first, second and third storing units 201, 202, 203 which are connected to the central control unit 205. The central control unit 205 is connected to an input device 204 (the keyboard 282). The first storing unit 201 stores therein data of a plurality of character images such as alphanumeric character images and other various types of symbol images in association with character codes. The second storing unit 202 stores therein data of a plurality of frame pattern images in association with frame codes. The plurality of frame pattern images include a plurality of basic frame pattern images such as square images and rectangle images and a plurality of composite frame pattern images each of which is formed from at least one of the basic frame pattern images.

The input device 204 serves to receive input data representative of character images and frame pattern images to be combined into a desired stamp image. More specifically, the input device 204 receives the character codes and the frame pattern code representative of the character images and the frame pattern image. For example, when an operator desires to obtain the stamp image I as illustrated in FIG. 9, the operator operates the input device 204 to input character codes representative of the character images "A", "B", "C", "D", "E", "F", "G", "H" and "I" and a frame pattern code representative of the composite frame pattern image J which is formed from the basic frame pattern images J1, J2 and J3.

The central control unit 205 includes a selecting part 205*a* and a combining part 205*b*. The selecting part 205*a* selects data of the composite frame pattern image stored in the second storing unit 202 that corresponds to the frame pattern code inputted at the input device 204. In this illustration, the selecting part 205*a* selects the data of the composite frame pattern image J. The selecting part 205*a* further selects data of one or more character image stored in the first storing unit 201 that corresponds to the character code inputted at the input device 204. In this illustration, the selecting part 205*a* selects the data of the character images "A", "B", "C", "D", "E", "F", "G", "H" and "I". The combining part 205*b* combines or synthesizes the thus selected character images and the selected frame pattern image into a stamp image. The combining unit 205*b* performs the combining operation with the use of the third storing unit 203. The third storing unit 203 is controlled by the central control unit 205 to temporarily store therein the selected character images in association with the basic frame pattern images of the selected composite frame pattern image which are desired to be combined with the corresponding character images. More specifically, the third storing unit 205 stores therein the selected character images to be combined with each of the basic frame pattern images of the composite frame pattern image, in association with the corresponding basic frame pattern image, as a result of which each of a plurality of stamp image areas for a stamp image is generated. In other words, each basic frame pattern image is combined with the corresponding character images, so that each stamp image area is generated. In this illustration, the characters "A", "B" and "C" are stored together with the basic frame pattern J1, so that a stamp image area I1 is obtained. The characters "D", "E" and "F" are stored together with the basic frame pattern J2, so that another stamp image area I2 is obtained. The characters "G", "H" and "I" are stored together with the basic frame pattern J3, so that a further stamp image area I3 is obtained. The combining part 205*b* then combines the thus produced plurality of stamp image areas into the desired stamp image. In this illustration, the combining part 205*b* combines or synthesizes the three stamp image areas I1, I2 and I3 into the stamp image I.

Next, a concrete example of the operation control unit 200 will be described in greater detail.

Figure 11:
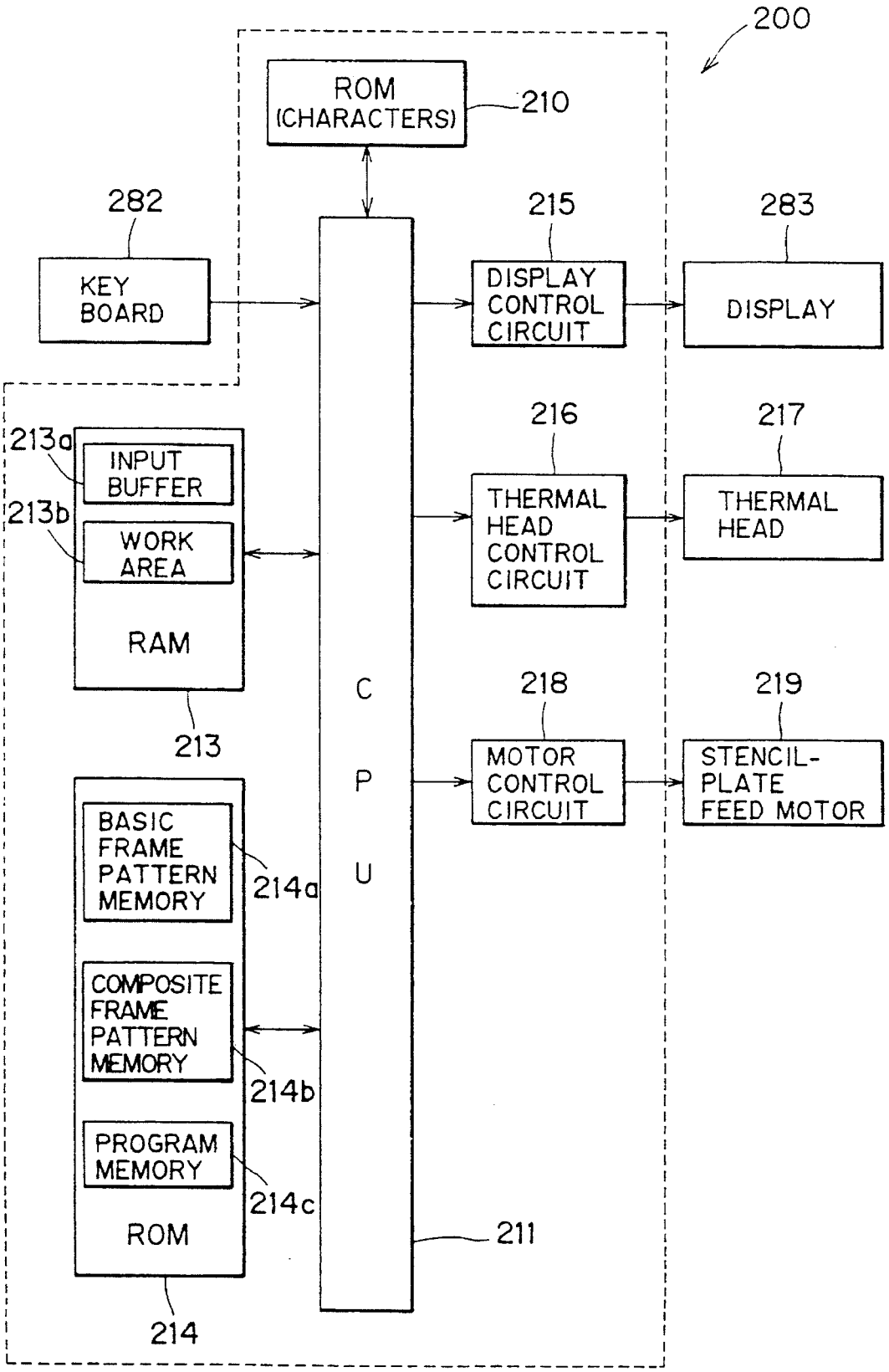
FIG. 11 is a block diagram showing a concrete example of the operation control unit of FIG. 10.
Figure 12A:
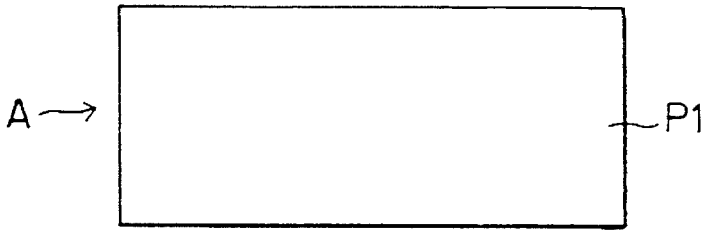
FIGS. 12*a*, 12*b*, 12*c*, 12*d* and 12*e* show representative examples of frame patterns stored in a ROM 214.
Figure 12B:
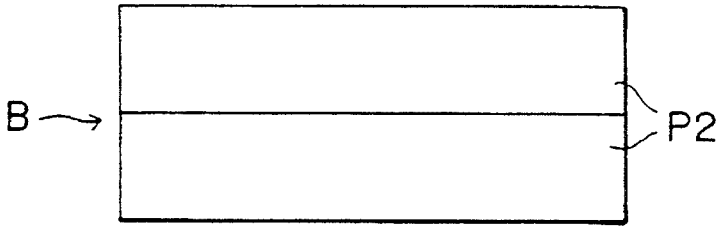
Figure 12C:
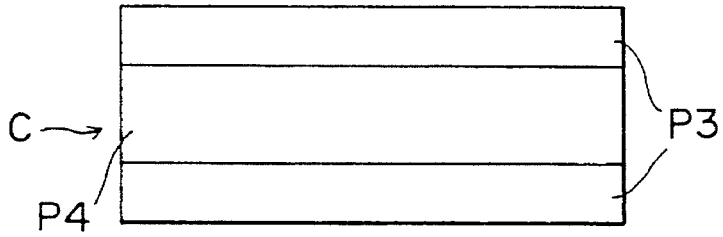
Figure 12D:
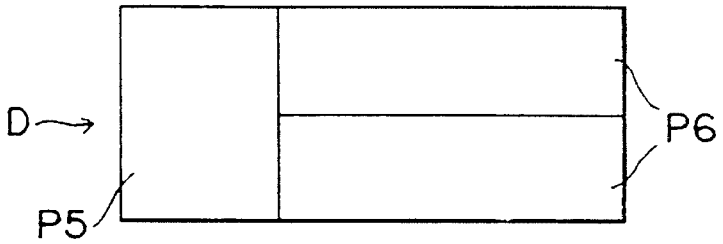
Figure 12E:
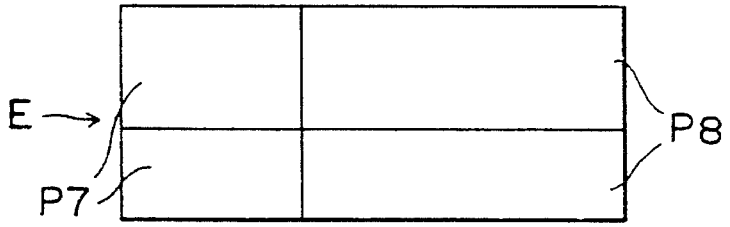

As shown in a block diagram of FIG. 11, a central processing unit (CPU) 211 which serves as the central control unit 205 of FIG. 10 is connected to and receives the input data inputted from the keyboard 282 which serves as the input device 204 of FIG. 10. The CPU 211 is also connected to a first read-only-memory (ROM) 210, a second read-only-memory (ROM) 214 and a random-access-memory (RAM) 213 which respectively serve as the first, second and third storing units 201, 202, 203 of FIG. 10. More specifically, the first ROM 210 stores therein data of a plurality of character images and a plurality of character codes which respectively represent the plurality of character images. The second ROM 214 stores therein data of a plurality of frame pattern images and a plurality of frame codes which respectively represent the plurality of frame pattern images. More specifically, the second ROM 214 includes: a basic frame pattern memory 214*a* for storing therein data of a plurality of basic frame pattern images and a plurality of frame codes representative thereof; and a composite frame pattern memory 214*b* for storing therein data of a plurality of composite frame pattern images each of which is formed from one or more basic frame pattern images and a plurality of frame codes representative thereof. It is noted that the second ROM 214 further includes a program memory 214*c* for storing therein programs for controlling overall operation of the apparatus 280.

FIGS. 12*a* through 12*e* show representative examples of the frame pattern images stored in the memories 214*a* and 214*b*. More specifically, representative examples for the basic frame pattern images are designated by characters P1 through P8. Representative examples for the composite frame pattern images are designated by characters A, B, C, D and E. An outline of each of the composite frame pattern images A through E defines an outline of an area of a stamp image desired to be produced, with areas defined by each outline being equal. (For example, the areas of stamp images desired to be stamped are all selected to have a single value of 13.5 [mm]×63.5 [mm]).

As apparent from FIGS. 12*a* through 12*e*, the composite frame pattern A is made from a single basic frame pattern P1. The composite frame pattern B is made from two basic frame patterns P2 which are obtained by dividing the basic frame pattern P1 horizontally. The composite frame pattern C is made from one basic frame pattern P4 sandwiched between two basic frame patterns P3 which are obtained by dividing the basic frame pattern P1 twice horizontally so that the area of the basic frame pattern P4 is larger than that of the basic frame pattern P3. The composite frame pattern D is made from one basic frame pattern P5 and two basic frame patterns P6. The basic frame pattern P5 is obtained by dividing the basic frame pattern P1 vertically so that a length of pattern P5 is one third that of pattern P1. The two basic frame patterns P6 are obtained by dividing horizontally the remaining area. The composite frame pattern E is made from two basic frame patterns P7 and two basic frame patterns P8. The basic frame patterns P7 and P8 are obtained by dividing the basic frame pattern P1 both horizontally and vertically.

In FIG. 11, the RAM 213 includes an input buffer area 213*a* and a work area 213*b*. The RAM 213 will preserve in the input buffer area 213*a* a plurality of input buffers $\mathbf{213}a_x$ (x= 1, 2, 3, . . . ). The work area 213*b* serves as a storage area for temporarily storing therein processed data.

In the operation control unit 200, the CPU 211 is further connected to a display control circuit 215 for controlling the display 283, a thermal head control circuit 216 for controlling the thermal head 217, and a motor control circuit 218 for controlling a stencil-plate feed motor 219 to transport the stencil-plate 250.

As described above, according to the present embodiment, since the composite frame pattern images are stored in the ROM 214, it becomes unnecessary for the CPU 211 to calculate a desired composite frame pattern image from a plurality of basic frame pattern images. It is sufficient that the operator selects a desired composite frame image from the stored plural composite frame pattern images.

With the stamp producing apparatus 280 constructed as described above, a stamping member 260' capable of stamping a desired stamp image is produced, in the following manner.

When an operator desires to obtain a stamping member

260' for stamping a desired stamp image, the operator first inserts the blank stencil-plate 250 through the insertion port 286. Then, the operator operates the keyboard 282 to cause the apparatus to enter a frame select mode. Then, the operator operates the keyboard 282 to select character images and frame pattern images to be combined into the desired stamp image. More specifically, the operator first depresses a key indicating a frame code representative of a composite frame pattern image which will form the basic structure of the desired stamp image. The operator further depresses keys indicating character codes representative of character images to be contained in the desired frame image. As a result, the selected character images and the selected frame pattern image are combined into the desired stamp image in the operation control unit 200. The obtained stamp image is displayed at the display 283 as input. After confirming that the stamp image displayed at the display 283 is as desired, the operator depresses the stencil-produce switch 284 so that a stencil production operation is started. In the stencil production operation, the stencil-plate feed motor 219 starts rotating to drive the stencil-plate feed mechanism to transport the blank stencil-plate 250 forward in contact with the thermal head 217. As the stencil-plate 250 advances in contact with the thermal head 217 (not shown), the thermal head 217 selectively heats to melt the thermoplastic film 251 to form perforations therein which define a stencil image corresponding to the stamp image produced in the operation control unit 200. The stencil-plate feed mechanism transports the resultant stencil-plate 250 further toward the stencil-holder slot 287. When the stencil-plate 250 is positioned below the stencil-holder 250 in the stencil-holder slot 287, the stencil-production operation is completed. The operator then manually holds the grip 261 and presses the stencil-holder 260 against the stencil-plate 250. As a result, the adhesive layer 263 of the stencil-holder 260 adheres to the film 258 of the stencil-plate 250. The operator then removes the stencil-holder 260 thus attached with the stencil-plate 250 from the stencil-holder slot 287. The operator manually peels off the separator sheet 255 from the stencil-plate 250 so that the ink-permeated non-woven fabric 256 directly contacts the stencil paper 254. Accordingly, the stamping member 260' is produced. The operator manually holds the grip 261 of the stamping member 260' and presses it against the object 270 so that the stencil paper 254 with the stencil image formed therein is pressed against the object 270. As a result, the ink seeps out of the non-woven fabric 256, through the holes in the stencil paper 254, and forms a stamp image on the object 270 corresponding to the stencil image.

Figure 15:
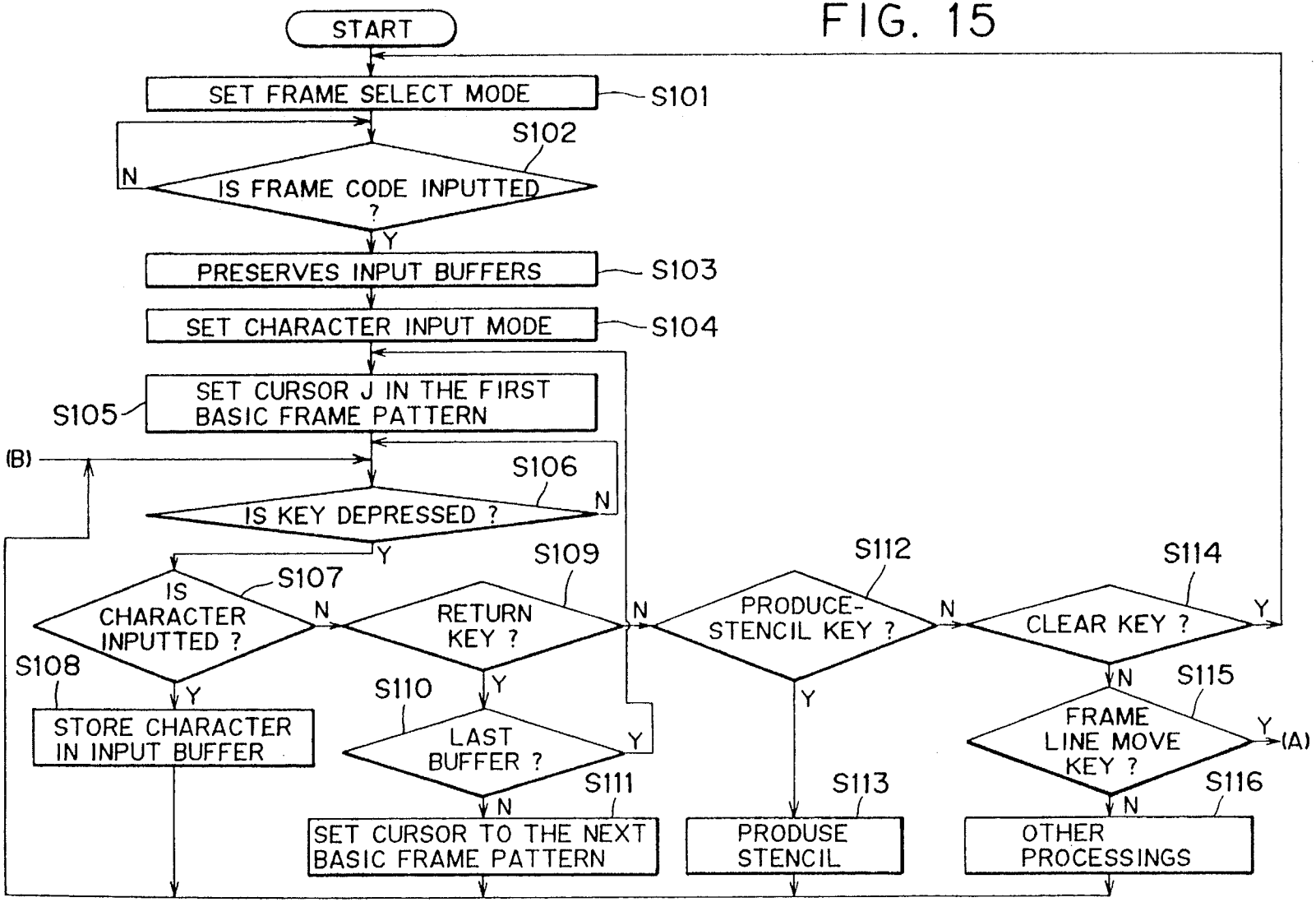
FIGS. 15 and 16 show a flow chart showing operation of the stamp producing apparatus of FIG. 7*a;*
Figure 16:
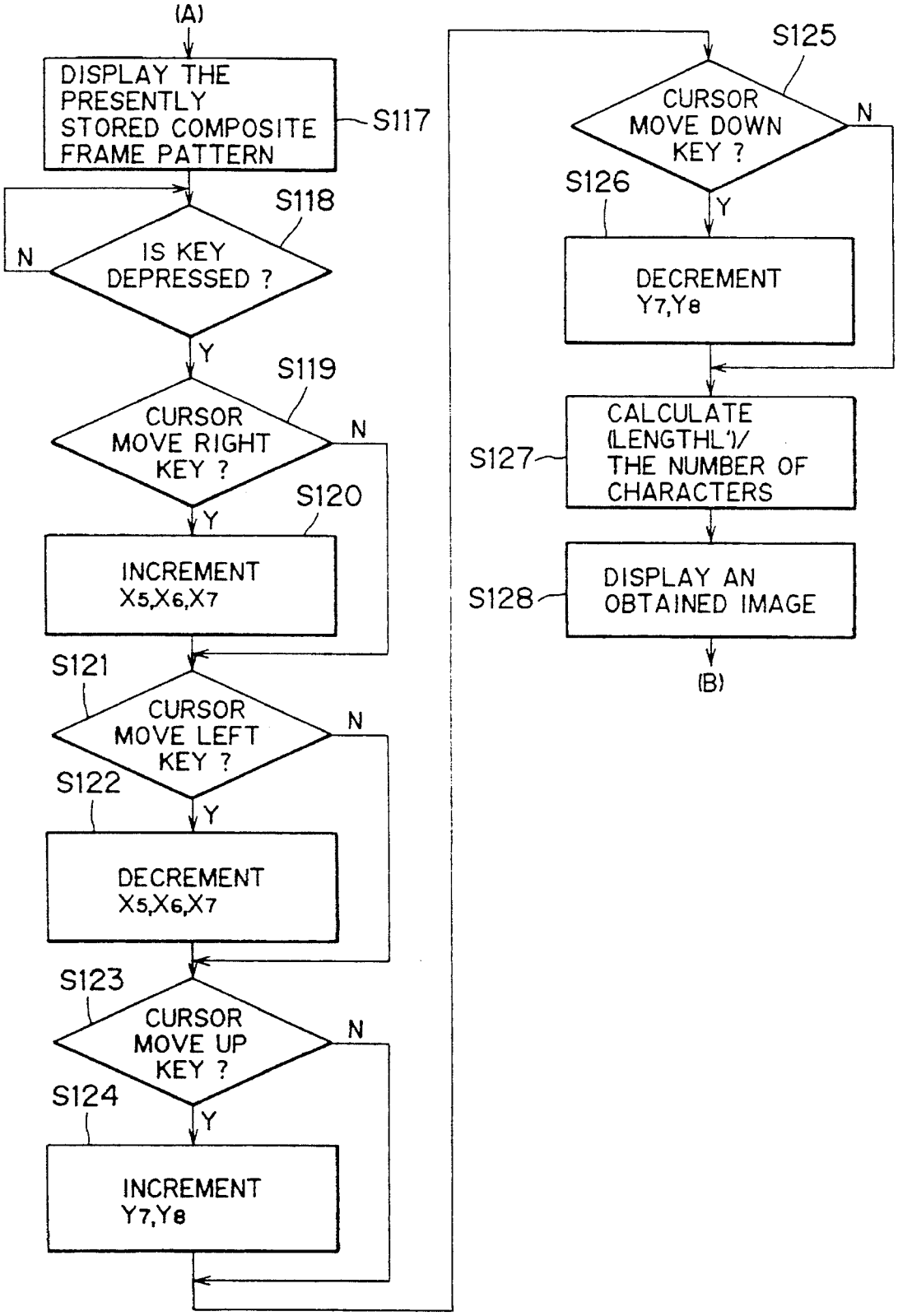

The operation of the apparatus 280 will be described in greater detail below with reference to the flow chart shown in FIGS. 15 and 16.

Figure 14A:
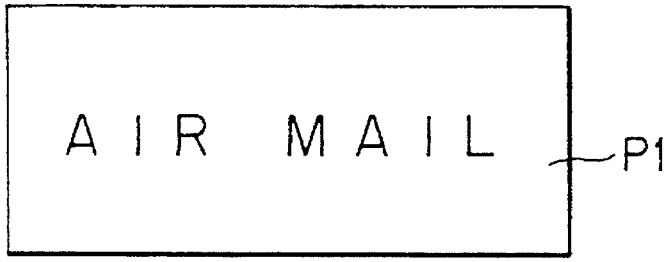
FIGS. 14*a*, 14*b*, 14*c*, 14*d* and 14*e* show representative examples of stamp images to be obtained by the stamp producing apparatus shown in FIG. 7*a;*
Figure 14B:
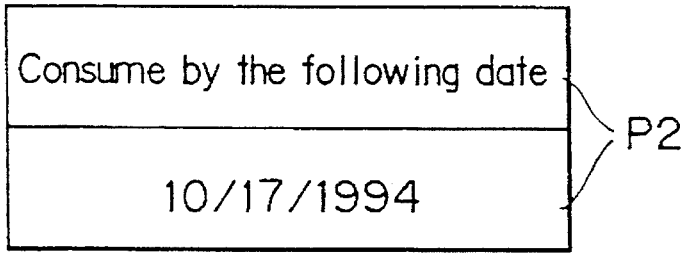
Figure 14C:
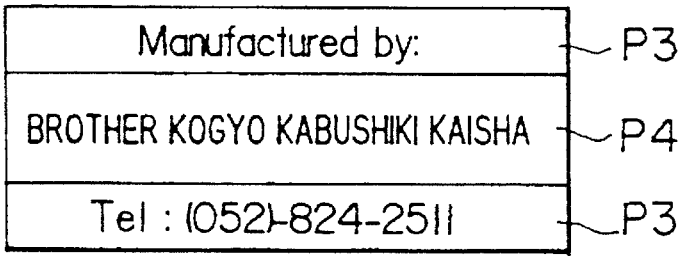
Figure 14D:
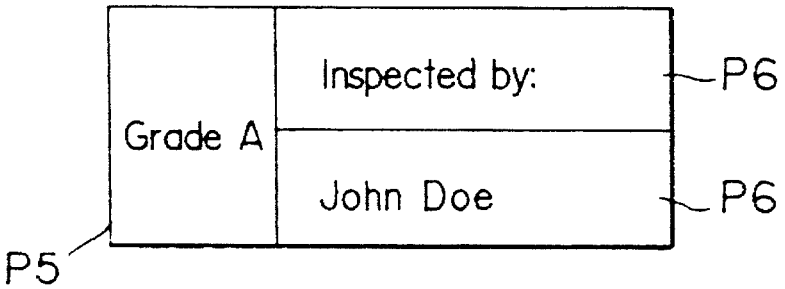
Figure 14E:
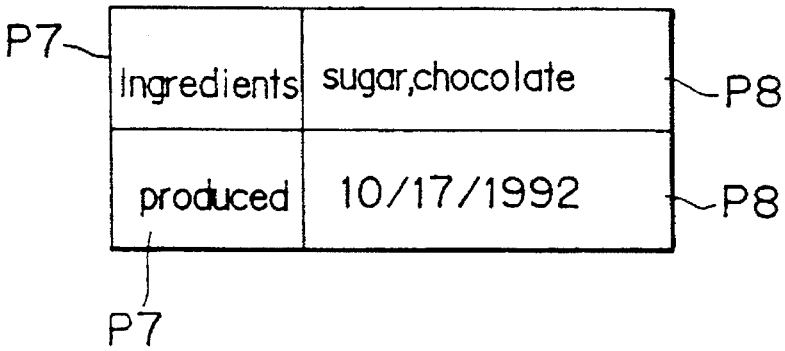

After inserting the blank stencil-plate 250 in the insertion port 286, the operator operates the keyboard 282 to cause the apparatus to enter a frame select mode, in step S101. Then, the program proceeds to step S102 where the CPU 211 judges whether or not a frame pattern code is inputted. The operator then depresses a key on the keyboard 282 to input a frame code representative of the composite frame pattern image desired to be the basic structure of the stamp image. For example, when the operator desires to produce a stamp image as shown in FIG. 14*d* which has the composite frame pattern D shown in FIG. 12*d*, if a frame pattern code "D" represents the composite frame pattern D, the operator depresses the key "D." When the CPU 211 judges that a frame pattern code is thus inputted in step S102, the CPU 211 retrieves, from the memory 214*b*, data for the composite frame pattern D, and then controls the display control circuit 215 to allow the display 283 to display the composite frame buffers $\mathbf{213}a_x$ in the input buffer area 213 so that the number pattern image D. In step S103, the CPU 211 preserves input of the thus preserved input buffers $\mathbf{213}a_x$ may become equal to the number of the basic frame patterns constituting the selected composite frame pattern. The input buffers $\mathbf{213}a_x$ are preserved for temporarily storing therein data for basic frame patterns of the inputted composite frame pattern. In this illustration, the composite frame pattern D includes three basic frame patterns (which will be referred to as a "first basic frame pattern P5", a "second basic frame pattern P6" and a "third basic frame pattern P6," hereinafter). Accordingly, the CPU 211 prepares three input buffers (a first input buffer $\mathbf{213}a_1$, a second input buffer $\mathbf{213}a_2$ and a third input buffer $\mathbf{213}a_3$) for respectively storing therein data for the basic frame patterns P5, P6 and P6. The CPU 211 then retrieves, from the memory 214*a*, data for all of the basic frame patterns constituting the selected composite frame pattern and stores them to the prepared input buffers. In this illustration, the CPU retrieves, from the memory 214*a*, data for the basic frame patterns P5, P6 and P6, and stores them to the input buffers $\mathbf{213}a_1$, $\mathbf{213}a_2$ and $\mathbf{213}a_3$, respectively.

Figure 13A:
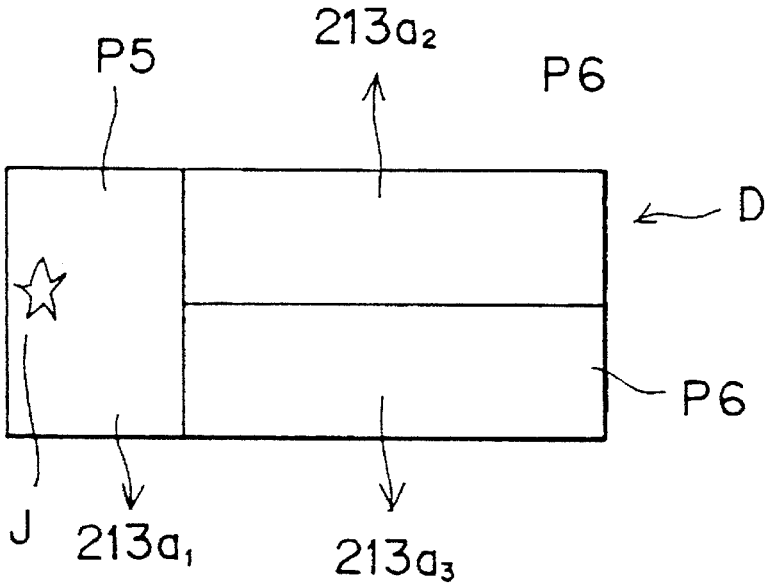
FIGS. 13*a* and 13*b* show the manner how the frame pattern and the character patterns are stored in input buffers 213*a* and are displayed on a display 283.

Then, the CPU 211 causes the apparatus to enter character input mode, in step S104. In step S105, the CPU 211 then selects the first input buffer $\mathbf{213}a_1$ in which the first basic frame pattern has been stored, and sets a cursor J in the first basic frame pattern P5 of the composite frame pattern D displayed on the display 283, as shown in FIG. 13*a*. It is then judged in step S106 whether or not any key on the keyboard 282 is depressed. Accordingly, when the operator depresses the keys for the desired characters, the process proceeds to step S107 where the CPU 211 judges whether or not the depressed key represents a character. If the depressed key represents a character, the CPU retrieves, from the ROM 210, data for the inputted character, and stores the data in the first input buffer $\mathbf{213}a_1$. Steps S106 through S108 are repeatedly conducted until data of all the characters desired to be contained in the first basic frame pattern P5 are stored in the first input buffer $\mathbf{213}a_1$. In this illustration, if the operator desires to input the characters "Grade A" into the first basic frame pattern P5 of the composite frame pattern D, the operator depresses the keys representative of the characters "G", "r", "a", "d", "e," and "A." The CPU stores data of the characters in the input buffer $\mathbf{213}a_1$. In this instance, the CPU performs calculations necessary to suitably position the characters "Grade A" to attractively combine the first basic frame pattern P5 with the character images "Grade A" as shown in FIG. 13*b*.

When it is determined that the depressed key does not represent a character in step S107, on the other hand, the CPU further judges in step S109 whether or not the depressed key is a return key. The return key is depressed for moving the cursor J from the basic frame pattern in which the cursor J is presently positioned to the next basic frame pattern. If the depressed key is the return key, it is further judged whether or not the present basic frame pattern in which the cursor J is presently positioned is the last basic frame pattern, in step S110. In other words, in step S110, it is judged whether or not input of the characters has been conducted for all the input buffers $\mathbf{213}a_x$ preserved for all the basic frame patterns of the composite frame pattern. (In this illustration, step S110 judges whether or not the present basic frame pattern in which the cursor J is presently positioned is the third basic frame pattern P6.) If the present basic frame pattern is not the last basic frame pattern, the CPU moves the cursor J to the next basic frame pattern, in step S111. The program then returns to step S106, and steps S107 through S111 are repeatedly conducted until when all the characters desired to be contained in all the basic frame patterns of the composite frame pattern are inputted into all the input buffers 213$a_x$.

Figure 13B:
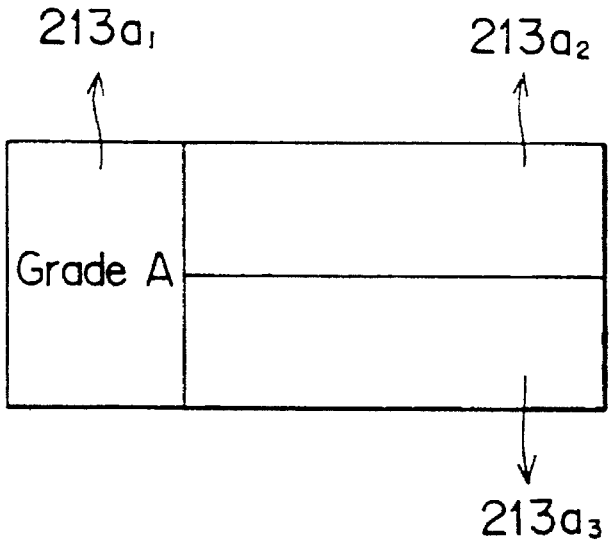

In this illustration, when all the characters "Grade A" has been inputted into the first input buffer 213$a_1$, as shown in FIG. 13*b*, the operator depresses the return key. The cursor J then moves from the first basic frame pattern P5 to the second basic frame pattern P6. The program then returns to step S106, and steps S106 through S111 are repeatedly conducted until when all the characters "Inspected by:" which are desired to be contained in the second basic frame pattern P6 are inputted into the second input buffer 213$a_2$. Then, the operator depresses the return key, again. The cursor J moves from the second basic frame pattern P6 to the third basic frame pattern P6. The program then further returns to step S106, and steps S106 through S111 are repeatedly conducted until all the characters "John Doe" which are desired to be contained in the third basic frame pattern P6 are inputted into the third input buffer 213$a_3$. As a result, all of the basic frame patterns of the selected composite frame pattern are combined with the desired characters, and the desired stamp image shown in FIG. 14*d* is obtained.

After all the characters desired to be contained in the stamp image are stored in all the preserved input buffers 213*a*, the operator depresses the produce-stencil switch 284. Accordingly, in step S112, the CPU determines that the produce-stencil switch 284 is depressed. Process then goes to step S113 in which the CPU 211 first transfers, to the thermal head control circuit 216, data for the characters and the frame patterns stored in the input buffers 213*a*. In this illustration, the CPU 211 transfers, to the thermal head control circuit 216, data for the first basic frame pattern P5 and the characters "Grade A" which are stored in the input buffer 213$a_1$, data for the second basic frame pattern P6 and the characters "Inspected by:" which are stored in the input buffer 213$a_2$ and data for the characters "John Doe" and the third basic frame pattern P6 which are stored in the input buffer 213$a_3$. In other words, the CPU transfers, to the thermal head control unit 216, data for the desired stamp image shown in FIG. 14*d* obtained in the input buffers 213*a*. Then, the CPU controls the motor control circuit 218 to start rotating the motor 219 and start feeding the blank stencil-plate 250. Accordingly, the already-described stencil production operation is started to be conducted in the apparatus 280. More specifically, the thermal head control circuit 216 controls the thermal head 219, in accordance with the supplied data for the desired stamp image, to thereby form holes on the stencil paper 254 on the blank stencil-plate 250. As a result, the stencil plate 250 is formed with a stencil image corresponding to the stamp image. In this example, a stencil image corresponding to the stamp image shown in FIG. 14*d* is formed on the stencil-plate 250. Thus, a desired stencil is produced. When the stencil is thus produced, if the operator depresses a clear key (not shown) on the keyboard 282 as judged in step S114, all the information inputted into the input buffers 213*a* is erased, and the program will return to the step S101. Accordingly, it is possible to further produce other desired stamp images such as shown in FIGS. 14*a* through 14*c* and 14*e* with using the composite frame pattern images shown in FIGS. 12*a* through 12*c* and 12*e*.

In the above-described operation, one of the plural composite frame patterns stored in the memory 214*b* is selected, and the selected one composite frame pattern is used as it is. The above-described operation can therefore be conducted where an external dimension of each of the basic frame patterns of the composite frame pattern retrieved from the memory 214*b* suits dimensions of the character patterns to be combined with the corresponding basic frame pattern. Combining character patterns with a composite frame pattern in this way provides stamps with good aesthetic balance. On the other hand, where the external dimension of each of the basic frame patterns of the composite frame pattern stored in the memory 214*b* does not suit the dimensions of the character patterns, according to the present embodiment, outlines of the basic frame patterns of the composite frame pattern can be shifted so that the external dimensions of the basic frame patterns may be altered to suit the dimensions of the character patterns.

Figure 17A:
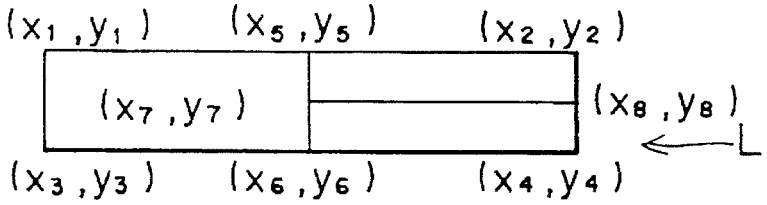
FIGS. 17*a*, 17*b*, 17*c*, 17*d* and 17*e* show the manner of shifting frame lines of a frame pattern.

In order to alter the external dimensions of the basic frame patterns of the selected composite frame pattern as described above, the following operation should be conducted.

Where the operator desires to alter the external dimensions of the basic frame patterns of the selected composite frame pattern, the operator does not depress the clear key in the step S114, but depresses a frame line move key (not shown) on the keyboard 282. When it is determined that the frame line move key is depressed in step S115, as shown in FIG. 16, the CPU controls the display 283 to display the composite frame pattern presently stored in the input buffers 213*a*, in step S117. In this illustration, the composite frame pattern D shown in FIG. 17*a* is displayed on the display 283. In FIG. 17*a*, the composite frame pattern is labeled L, and points where frame lines of the composite frame pattern L intersect are represented by coordinates ($X_n$, $Y_m$) where n, m=1, 2, . . . , 8. Then, the program goes to a stand-by state in step S118 where the CPU 211 judges whether or not the operator depresses a cursor move key (not shown) on the keyboard 282.

Figure 17B:
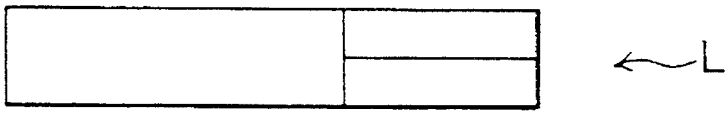
Figure 17C:
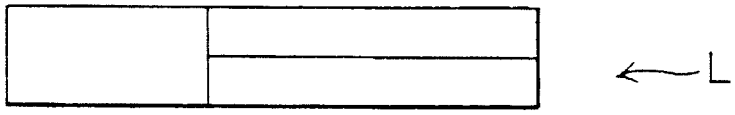
Figure 17D:
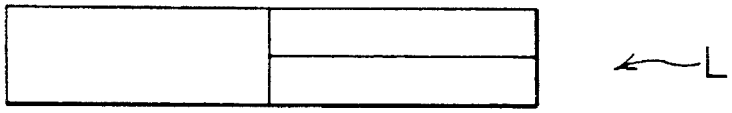
Figure 17E:
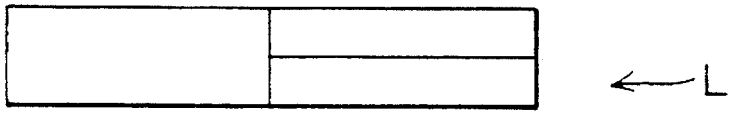

When the operator depresses the cursor move key, the CPU 211 judges whether or not the depressed cursor move key is a cursor move right key for instructing the cursor to move rightward, in step S119. If it is determined that the cursor move right key is depressed, the x coordinates of the points labeled ($x_5$,$y_5$), ($x_6$,$y_6$), and ($x_7$,$y_7$) in the composite frame pattern L are incremented in step S120, so that the frame line connected between the points ($x_5$, $y_5$) and ($x_6$, $y_6$) is moved rightward, as shown in FIG. 17*b*. It is further judged in step S121 whether or not the depressed key is a cursor move left key for instructing the cursor to move leftward. If it is determined that the cursor move left key is depressed, the x coordinates of the points labeled ($x_5$,$y_5$), ($x_6$,$y_6$), and ($x_7$,$y_7$) are decremented, in step S122, so that the frame line connected between the points ($x_5$, $y_5$) and ($x_6$, $y_6$) is moved leftward, as shown in FIG. 17*c*. It is then judged in step S123 whether or not the depressed key is a cursor move up key for instructing the cursor to move upward. If it is determined that the cursor move up key is depressed, the y coordinates of the points labeled ($x_7$,$y_7$) and ($x_8$,$y_8$) are incremented in step S124, so that the frame line connected between the points ($x_7$,$y_7$) and ($x_8$, $y_8$) is moved upward as shown in FIG. 17*d*. It is further judged in step S125 whether or not the depressed key is a cursor move down key for instructing the cursor to move downward. If it is determined that the cursor move down key is depressed, the y coordinates of the points labeled ($x_7$,$y_7$) and ($x_8$,$y_8$) are decremented in step S126, so that the frame line connected between the points ($x_7$, $y_7$) and ($x_8$, $y_8$) is moved downward as shown in FIG. 17*e*. Through the above-described operation, the external dimensions of the basic frame patterns of the composite frame pattern can be adjusted to a desired size.

Figure 18A:
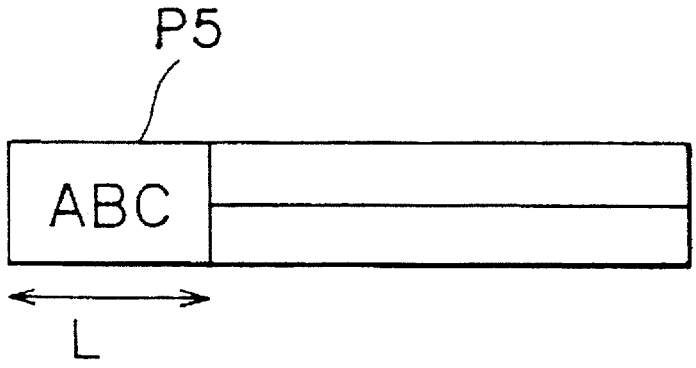
FIGS. 18*a* and 18*b* show the manner of changing a size of each character contained in a frame pattern.
Figure 18B:
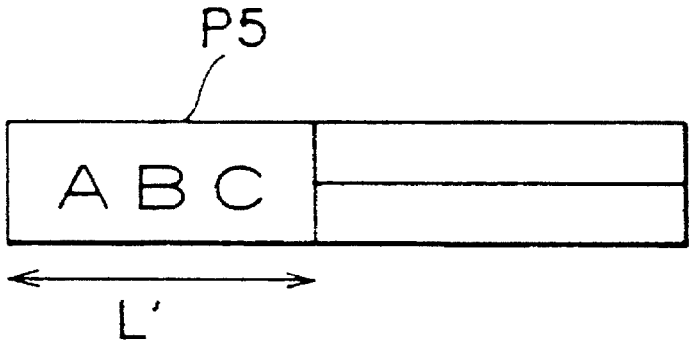

The program then proceeds to step S127. In step S127, the CPU 211 performs calculation to divide a value of length of each of the thus size-adjusted basic frame patterns in the lengthwise direction by the number of character patterns contained in the corresponding basic frame pattern, to thereby obtain a size for each character pattern that is suitable for the size of the size-adjusted basic frame pattern. For example, where the frame lines of the composite frame pattern shown in FIG. 18*a* are changed into those as shown in FIG. 18*b*, the length L of the basic frame pattern P5 is changed into another length L'. Accordingly, in step S127, the length L' is divided by three (3), which is the number of character patterns ("A", "B" and "C") to be combined in the basic frame pattern P5, so as to obtain a size of each character patterns suitable for the newly set length L'.

In step S128, then, a newly obtained stamp image with newly set coordinates and with a newly set character size is displayed on the display 283.

As apparent from the above description, it is possible to easily produce any desired stamp image having any desired frame pattern other than those stored in the memory 214*b*, through merely changing the shape of the frame pattern stored in the memory. According to the present invention, the sizes of the character patterns are adjusted in accordance with the dimension of the shape-changed frame pattern. Accordingly, it is possible to obtain a stamp image in which the character patterns and the frame pattern are attractively combined.

It is noted that when the clear key is not depressed in step S114 and the frame line move key is not depressed in step S115, a character processing operation such as a character canceling operation is performed in step S116 for erasing the data which have been already stored in the input buffer 213$a_x$.

As described above, a plurality of frame patterns are stored in the stamp producing apparatus of the present embodiment. Accordingly, in order to produce a desired stamp image, it is sufficient that the operator selects one of the frame patterns appropriate for character patterns to be contained in the desired stamp image. In order to produce a stamp image formed with any desired frame pattern which is not stored in the apparatus, it is possible to easily produce the desired frame pattern through altering dimension of the frame pattern stored in the apparatus. Where the dimension of the frame pattern stored in the apparatus is thus altered, the sizes of the character patterns are automatically adjusted to suit the altered dimension of the frame pattern. Accordingly, it is possible to easily produce any desired stamp image without complicated line drawing operation.

While the invention has been described in detail with reference to specific embodiments thereof, it would be apparent to those skilled in the art that various changes and modifications may be made therein without departing from the spirit of the invention.

For example, in the stamp apparatus 10 of the first embodiment, data for frequently used phrases are stored in the ROM 54 in association with phrase codes. Accordingly, the operator may operate the keyboard to simply input a phrase code representative of a phrase image desired to be stamped. It is noted that not only data for such frequently used phrase images but also data ,for other various kinds of frequently used stamp images may be stored in the ROM in association with codes. For example, if such a stamp image as has only one character at a predetermined position in its image surface is frequently used, data for the stamp image may be stored in the ROM in association with a code representative of the stamp image. In such a case, the operator may operate the keyboard to simply input the code representative of the stamp image.

In the stamp producing apparatus 280 of the second embodiment, one composite frame pattern desired to be contained in the stamp image is selected through the operation of the keyboard. However, a plurality of basic frame patterns desired to be contained in the stamp image may be selected. More specifically, the ROM 214 stores therein the plurality of basic frame patterns in association with the plurality of basic frame codes representative of the basic frame patterns. Accordingly, the operator can operate the keyboard to input basic frame codes representative of basic frame patterns desired to be contained in the desired stamp image. For example, in order to obtain a stamp image as shown in FIG. 14*d*, the operator may select the basic frame patterns P5, P6 and P6 shown in FIG. 12*d* through simply operating the keyboard to input the basic frame codes for the patterns P5, P6 and P6.

Furthermore, the ROM 210 of the operation control unit 200 of the second embodiment may further include data of frequently used phrases, in the similar manner as in the first embodiment. For example, the frequently used phrase "AIR MAIL" shown in FIG. 14*a* may be stored in the ROM 210 in association with a phrase code therefor. In such a case, the operator can select the phrase "AIR MAIL" through simply operating the keyboard to input the phrase code for the phrase "AIR MAIL".

What is claimed is:

1. A stencil producing apparatus for producing a stencil having a desired stencil image, comprising:

storing means for storing a plurality of data representing a plurality of image forming elements of at least two types, one of said types being non-alphanumeric, said storing means includes a frame storing means for previously storing a plurality of frame data each representing a corresponding one of a plurality of frame images;

selecting means for selecting at least one of the plurality of data of each of the at least two types of image forming elements which constitutes a desired stencil image, said selecting means includes frame selecting means for selecting at least one of the plurality of frame data representing a frame image which constitutes a part of the desired stencil image;

combining means for combining the selected data of the at least two types of image forming elements into an image data corresponding to the desired stencil image; and perforating means for selectively perforating a blank stencil paper to form holes in accordance with the image data, to thereby produce a stencil having the desired stencil image.

2. The stencil producing apparatus as claimed in claim 1, wherein said storing means includes character set storing means for storing a plurality of character set data, each character set data representing a corresponding one of a plurality of sets of character images, each set of character images being formed from several character images, and wherein said selecting means includes character set selecting means for selecting one of the plurality of character set data representing a set of character images which constitutes the desired stencil image.

3. The stencil producing apparatus as claimed in claim 2, wherein said character set storing means previously stores the plurality of character set data of the plurality of sets of character images each being represented by a character set code data, and wherein said character set selecting means includes:

character set code input means for inputting a character set code data representative of one of the plurality of character set data of the plurality of sets of character images which constitutes the desired stencil image; and means for selecting one of the plurality of character set data in accordance with the inputted character set code data.

4. The stencil producing apparatus as claimed in claim 3, further comprising:

ink supplying means for supplying the stencil produced by said perforating means with ink; and pressing means for pressing the stencil supplied with the ink against an object to thereby stamp a stamp image corresponding to the desired stencil image.

5. The stencil producing apparatus as claimed in claim 1, wherein said storing means further includes character storing means for previously storing a plurality of character data each representing a corresponding one of a plurality character images, and wherein said selecting means further includes character selecting means for selecting at least one of the plurality of character data representing a character image which constitutes another part of the desired stencil image.

6. The stencil producing apparatus as claimed in claim 5, further comprising synthesizing means for synthesizing the at least one frame image selected by said frame selecting means and the at least one character images selected by said character selecting means to generate an image corresponding to the desired stencil image, and wherein said perforating means selectively perforates the blank stencil paper to form a hole corresponding to the synthesized image, to thereby produce a stencil having the desired stencil image.

7. The stencil producing apparatus as claimed in claim 6, further comprising shape-changing means for changing a shape of the at least one frame image selected by said frame selecting means into such a shape as suits the at least one character images selected by said character selecting means, wherein said synthesizing means synthesizes the shape-changed at least one frame image and the selected at least one character images to generate the image corresponding to the desired stencil image.

8. The stencil producing apparatus as claimed in claim 1, wherein said frame storing means previously stores the plurality of frame data of the plurality of frame images each being represented by a frame code data, and wherein said frame selecting means includes:

frame code input means for inputting at least one frame code data representative of the at least one of the plurality of frame images which forms a part of the desired stencil image; and means for selecting the at least one of the plurality of frame data in accordance with the inputted frame code data.

9. The stencil producing apparatus as claimed in claim 8, wherein the blank stencil includes an ink layer holding ink therein and a stencil image receiving layer formed of material capable of being perforated by said perforating means, further comprising pressing means for pressing the stencil against an object to thereby stamp a stamp image corresponding to the desired stencil image onto the object.

10. The stencil producing apparatus as claimed in claim 1, wherein the plurality of frame images include a plurality of basic frame images.

11. The stencil producing apparatus as claimed in claim 10, wherein the plurality of frame images further include a plurality of composite frame images each having a plurality of the basic frame images, and wherein said frame selecting means selects one of the plurality of composite frame images which forms a part of the desired stencil image.

12. A stencil producing apparatus for producing a stencil having a desired stencil image, comprising:

storing means for storing a plurality of data representing a plurality of image forming elements of at least two types, one of said types being non,alphanumeric, said storing means stores a plurality of character data representing a plurality of character images and a plurality of accessory data representing a plurality of accessory images to be combined with the character images, each of the plurality of accessory data includes a frame data representing a corresponding one of a plurality of frame images to be combined with the character images;

selecting means for selecting at least one of the plurality of data of each of the at least two types of image forming elements which constitutes a desired stencil image;

combining means for combining the selected data of the at least two types of image forming elements into an image data corresponding to the desired stencil image; and perforating means for selectively perforating a blank stencil paper to form holes in accordance with the image data, to thereby produce a stencil having the desired stencil image.

13. The stencil producing apparatus as claimed in claim 12, wherein said storing means previously stores the plurality of frame data of the plurality of frame images.

14. The stencil producing apparatus as claimed in claim 13, further comprising deforming means for deforming one of the character data and the frame data selected by said selecting means in accordance with the other one of the character data and the frame data so that the character image represented by the character data and the frame image represented by the frame data suit each other.

15. A stamp producing apparatus for producing a stamp member capable of stamping a desired stamp image onto a desired any kind of object, said stamp producing apparatus comprising:

character storing means for storing data of a plurality of character images and a plurality of character codes representative of the plurality of character images;

frame storing means for storing data of a plurality of frame images and a plurality of frame codes representative of the plurality of frame images;

input means for inputting at least one character code representative of at least one character image desired to be contained in a stamp image desired to be stamped on a desired any kind of object and at least one frame code representative of at least one frame image desired to be combined with the at least one character image into the desired stamp image;

selecting means for selecting at least one of the plurality of character images stored in said character storing means in accordance with the character code inputted in said input means and for selecting at least one of the plurality of frame images stored in said frame storing means in accordance with the frame code inputted in said input means;

combining means for combining data of the selected at least one character images and data of the selected at least one frame images into data of the desired stamp image;

supporting means for supporting a blank stencil medium;

perforating means for selectively forming holes on the blank stencil medium supported by said supporting means, in accordance with the data of the desired stamp image produced by said combining means, to thereby produce a stencil formed with a stencil image corresponding to the desired stamp image; and attaching means for attaching the thus produced stencil onto a stencil holding member to thereby produce a stamp member capable of stamping the desired stamp image onto a desired any kind of object.

16. The stamp producing apparatus as claimed in claim 15, wherein said frame storing means stores therein data of a plurality of basic frame images and a plurality of basic frame codes representative of the plurality of basic frame images, and wherein said input means receives a plurality of basic frame codes representative of a plurality of basic frame images which are desired to be respectively contained in a plurality of image sections of the desired stamp image and receives at least one character code representative of at least one character image desired to be contained in each of the plurality of image sections of the desired stamp image.

17. The stamp producing apparatus as claimed in claim 16, wherein said selecting means selects at least one character image out of said character storing means in accordance with the character code inputted in said input means and selects the plurality of basic frame images out of said frame storing means in accordance with the plurality of basic frame codes inputted in said input means, and wherein said combining means includes:

image section data producing means for combining data of each of the selected plural basic frame images and data of the selected at least one character images desired to be contained in the corresponding one of the plurality of basic frame image into data for each of the plurality of image sections of the desired stamp image; and image data producing means for combining data for all of the plurality of image sections of the desired stamp image into data of the desired stamp image.

18. The stamp producing apparatus as claimed in claim 15, wherein said frame storing means stores therein data of a plurality of composite frame images and a plurality of composite frame codes representative of the plurality of basic frame images, each of the plurality of composite frame images including a plurality of basic frame images, and wherein said input means receives one composite frame code representative of one composite frame image which is desired to be contained in the desired stamp image and which has a plurality of basic frame images defining a plurality of image sections of the desired stamp image and receives at least one character code representative of at least one character image desired to be contained in each of the plurality of image sections of the desired stamp image.

19. The stamp producing apparatus as claimed in claim 18, wherein said selecting means selects at least one character image out of said character storing means in accordance with the character code inputted in said input means and selects one composite frame image out of said frame storing means in accordance with the one composite frame code inputted in said input means, and wherein said combining means includes:

image section data producing means for combining data for each of the plural basic frame images of the selected one composite frame image and data of the selected at least one character images desired to be contained in the corresponding basic frame image into data for each of the plurality of image sections of the desired stamp image; and image data producing means for combining data for all of the plurality of image sections of the desired stamp image into data of the desired stamp image.

20. The stamp producing apparatus as claimed in claim 19, wherein the blank stencil medium includes an ink pad layer permeated with ink and a stencil image receiving layer formed of material capable of being perforated by said perforating means.

21. The stamp producing apparatus as claimed in claim 15, further comprising deforming means for deforming one of the at least one character image and at least one frame image selected by said selecting means in accordance with the other one of the at least one character image and at least one frame image so that the at least one character image and the at least one frame image suit each other.

* * * * *